United States Patent [19]

Haas et al.

[11] Patent Number: 4,955,185

[45] Date of Patent: Sep. 11, 1990

[54] INSERTION MACHINE

[75] Inventors: Dave Haas, Schaumburg; Gary VanderSyde, Naperville; Paul Beatty; Ren Roxas, both of Chicago, all of Ill.

[73] Assignee: Bell & Howell Company, Chicago, Ill.

[21] Appl. No.: 271,258

[22] Filed: Nov. 15, 1988

Related U.S. Application Data

[62] Division of Ser. No. 30,015, Mar. 25, 1987, Pat. No. 4,798,040.

[51] Int. Cl.[5] ..... B65B 25/14

[52] U.S. Cl. ..... 53/460; 53/493; 53/494; 53/77; 53/569; 53/266 A

[58] Field of Search ..... 53/460, 493, 494, 569, 53/77, 258, 266 A

[56] References Cited

U.S. PATENT DOCUMENTS

| | | | |
|---|---|---|---|
| 1,960,959 | 5/1934 | Sague | 53/569 X |
| 2,325,455 | 7/1943 | Williams | 53/266 A |
| 3,368,321 | 2/1968 | Sather | 53/569 |
| 4,205,506 | 6/1980 | Moens et al. | 53/266 A |
| 4,337,609 | 7/1982 | Foster et al. | 53/266 A |
| 4,443,007 | 4/1984 | Adamoski | 53/266 A |
| 4,524,557 | 6/1985 | Silverman | 53/77 |
| 4,577,848 | 3/1986 | Hams | 53/266 A |

*Primary Examiner*—John Sipos

*Attorney, Agent, or Firm*—Griffin, Branigan & Butler

[57] ABSTRACT

An insertion machine includes an insertion station (44) whereat groups of items are stuffed into an envelope held open at an envelope opening station (49). The insertion station comprises an cam (212)-driven carriage (202) which linearly reciprocates in a direction (480) toward and away from the envelope opening station (49). The carriage (202) carries a plurality of selectively mounted, selectively rotatable pusher fingers (204). The pusher fingers (204) have a profile suitable for shoving items along a partially inclined insertion plate surface 403 and into an opened envelope. The pusher fingers (204) are selectively rotatable to an operative orientation (720) and to an inoperative orientation (722) under the supervision of a controller (205). Jam detectors (550, 552) are provided proximate reciprocating entry fingers (500, 502) which move when a jam occurs in the inserting process. Should a jam occur, the pusher fingers (204) are controlled to rotate to their inoperative orientation (722). Access to the jam location is obtained by rotating the carriage (202) about an axis (415) and by swinging an envelope opening gate (660) about another axis (662). After the inserting of a group of items into an envelope, a flap moistener (70) detects a change in electromagnetic flux as the result of the travel of an opened envelope flap and sprays an atomized fluid along spaced-apart paths (699A, 699B) onto gummed regions of the envelope flap.

32 Claims, 12 Drawing Sheets

INSERTION MACHINE

This is a divisional of application Ser. No. 030,015, filed Mar. 25, 1987, now U.S. Pat. No. 4,798,040.

BACKGROUND OF THE INVENTION

I. Field of the Invention

This invention pertains to collating or insertion machines, and particularly to such machines wherein a group of related items are stuffed or inserted into a packaging medium such as an envelope II. Prior Art and Other Considerations In a conventional insertion machine, series of related items, such as documents commonly referred to as "inserts", are associated together and inserted or "stuffed" into an awaiting, flap-opened envelope. Thereafter the stuffed envelope is sealed and various other operations can be performed, such as associating the stuffed envelopes with an appropriate postage weight category and/or grouping or sorting by zip code or in accordance with other criteria.

In a very popular type of insertion machine, an envelope and insert are respectively transported to an insertion station on two parallel tracks or conveyors, namely an insert track provided on a machine back table and an envelope track provided on a machine front table. Typically these tracks are indexed in a direction toward the insertion station in accordance with a machine cycle, e.g. with the track advancing essentially one track space toward the insertion station for every one revolution of a machine main timing shaft.

The insert track for the type of machine being described traditionally comprises a pair of endless chains which travel in front of a series of feeder stations. Each chain has a plurality of pusher pins provided thereon for causing inserts fed onto the chain pair to be driven in the direction toward the insertion station in accordance with machine timing.

At the insertion station, a three-fingered unit is used to shove a group of stacked, related inserts into an awaiting envelope. The three-fingered unit is connected to the distal end of a large, angularly swinging arm. The proximal end of the swinging arm is ultimately connected to the insertion machine mainframe so that a follower roller associated with the swinging arm follows a cam on the machine main drive shaft. The three-fingered unit drives the group of items into the awaiting envelope during a certain portion of the machine operating cycle.

An example of the type of insertion machine briefly described above is shown in U.S. Pat. No. 2,325,455 to A. H. Williams. Despite their mechanical intricacies, modern insertion machines of this type have amazing throughput and operate at very high speeds on the order of about 10,000 cycles per hour. It is a remarkable feat, for example, that by coordinated mechanical action, an insertion machine can register a group of inserts at an insertion station; open a flap of an awaiting envelope; and, mechanically stuff a group of inserts into the open envelope with such rapidity. Yet, as the mailings prepared by such entities as financial institutions, utilities, governmental bodies and direct mail concerns continue to proliferate, it is evident that machines of comparable function but with even faster operational speeds would be welcome. Hence, an object of this invention is the provision of an insertion machine capable of high operating speeds, and in particular the provision of an insertion station and method of operating the same wherein groups of inserts are stuffed into envelopes in an expeditious and efficient manner.

Although rather infrequent, heretofore some problems have been experienced at conventional insertion stations of the type described above. On some occasions the eccentric connection of the angularly swinging arm has caused the multi-fingered shoving unit to bounce with respect to the insertion machine back table, with the result that the multi-fingered shoving unit may not be situated properly behind and beneath the stack of inserts for getting under those inserts and for driving those inserts into the awaiting, flap-opened envelope. On rare occasion such a bounce has resulted in the multi-fingered shoving unit actually moving above, rather than beneath, the stack of inserts. Hence, an advantage of the present invention is the provision of method and apparatus relative to an insertion machine having an insertion station whereat the means for shoving inserts into an awaiting envelope is consistently properly positioned for effectively shoving those inserts.

Prior art insertion stations which employed a shoving unit consisting of three fingers encountered problems when different sized inserts were included in a group, especially when rather small inserts were included in a group being stuffed into a relatively large envelope. In this regard, a small insert might be struck during the stuffing operation by just one fingers in which case the small insert might go askew into the envelope. Therefore, another advantage of the present invention is the provision of method and apparatus relative to an insertion machine having an insertion station wherein inserts of varied sizes are properly guided into awaiting envelopes.

When a group of inserts is being stuffed into an awaiting, opened envelope at very high speeds, there is a tendency for the inserts to bounce back and out of the envelope. In this regard, the unopened edge of the envelope is aligned with or at least proximate to an envelope stop plate during the insertion operation. When inserts are rapidly inserted into an awaiting envelope, the momentum of the inserts can carry the inserts against the envelope stop plate, from whence the inserts can bounce off sufficiently to possibly partially protrude from the envelope rather than being completely enveloped therein. Therefore, an advantage of the present invention is the provision of method an apparatus relative to an insertion machine having an insertion station whereat inserts are accurately placed into an awaiting, flap-opened envelope.

Since insertion machines operate at such phenomenally fast speeds, there is the possibility that a paper jam may occur every once in awhile at the insertion station. Heretofore, if a jam did occur at the insertion station, continued movement of the multi-fingered shoving unit could damage the jammed inserts. If one or more inserts in a group were damaged to the extent that they were unmailable, additional insert(s) would have to be prepared for that group, some of which may be inique to that group, such as a customer statement or the like, for example. Regeneration of unique document or insert of this type is very troublesome at this stage of operation. Therefore, another advantage of the present invention is the provision of method and apparatus relative to an insertion machine having an insertion station having means to protect inserts should a jam occur.

When jams have occurred at conventional stuffing stations, insertion machine operators generally attempt to manually clear the jam. In order to clear an insertion station jam, an operator can move away from the insertion station a device that is used to open the awaiting envelope. Typically this envelope opening device comprises a plurality of sucker cups, usually four, connected by elongated stems to a horzontally elongated carriage. The envelope-opening carriage is rotatable about a horzontal axis which essentially parallels the major dimension of the envelope. Accordingly, when a jam occurs at the insertion station, the envelope opening device can be rotated away from the insertion station, so that the jam can be cleared.

Unfortunately, there is a propensity among machine operators to lift the envelope opening device out of the way of the insertion station by grabbing the elongated sucker cup stems. Manipulation of the sucker cup stems in this manner tends to deform the stems, with the result that the sucker cups are not thereafter precisely positioned with respect to an envelope ushered therebeneath. Consequently, vacuum may not be properly applied through all envelope-opening sucker cups. Thus, another advantage of the present invention is the provision of method and apparatus relative to an insertion machine having an envelope-opening device which is easily movable for clearing jams at an insertion station.

SUMMARY

An insertion machine includes an insertion station whereat groups of items are stuffed into an envelope held open at an envelope opening station. The insertion station includes a carriage which linearly reciprocates in a direction toward the envelope opening station and in a direction away from the envelope opening station. The carriage carries a plurality of selectively mounted, selectively rotatable pusher fingers. The pusher fingers are rotatable to a first orientation (whereat the fingers are usable for inserting an item into an envelope) and to a finger second orientation (whereat the fingers are inoperative and cannot insert an item into an envelope). Pusher finger orientation control means determines whether the finger moves to the finger first orientation or to the finger second orientation.

The pusher finger orientation control means includes a timing circuit, a solenoid, a pusher finger latch assembly, and a pusher finger reset assembly (also known as pusher finger orientation determination means). The pusher finger latch assembly serves to lock the pusher fingers in an orientation until the timing circuit pulses the solenoid so that the solenoid can unlock the latch assembly. When the pusher finger latch assembly is unlocked, the pusher finger reset assembly determines which orientation the pusher fingers should next acquire.

The pusher finger reset assembly which determines the next orientation of the pusher fingers includes two separate biasing means, particularly a pusher finger raising spring for urging the pusher fingers to the second orientation and a pusher finger lowering spring for urging the pusher fingers to the first orientation, as well as carriage location determination means. The carriage location determination means influences which of the biasing means will prevail in urging the pusher fingers to an orientation. The carriage location determination means includes an overhead ramp which extends only along a portion of the path of travel of the linearly reciprocating carriage. If the carriage is not under the overhead ramp, the finger raising spring will prevail in raising the pusher fingers to their inoperative or second finger position when the timing circuit pulses the solenoid.

The linear reciprocation of the carriage is occasioned by the linkage of the carriage to drive means including an cam mounted on a timing shaft. Driving the carriage by a cam and providing a pair of elongated guide rods for the carriage to engage facilitates a smooth, linear path of travel for the carriage, thereby precluding bounce of the pusher fingers. Moreover, utilization of a cam drive assists in the controlled acceleration of items being directed toward an opened envelope.

The carriage reciprocates back and forth with respect to the envelope opening station in accordance with the timing of a machine cycle. In particular, the carriage begins to travel forward at five degrees of the machine cycle (5 DMC) and reaches its furtherest extent of forward travel at 160 DMC. At zero DMC the timing circuit pulses the solenoid so that the pusher fingers are rotated to their first or operative orientation. At 160 DMC, after the pusher fingers have shoved a group of inserts into an opened envelope, the timing curcuit pulses the solenoid to cause the pusher fingers to rotate to their second or inoperative orientation.

The pusher fingers are also rotatable to their second or inoperative orientation when an error is detected in the inserting process, such as upon the occurance of a jam. When a jam occurs during the inserting process, the jammed item(s) sufficiently move entry fingers provided at the insertion station for the entry fingers to trip a microswitch associated with a jam detector. In particular, an entry finger is provided to extend into the open envelope at each end thereof, since jams generally occur proximate the ends of envelopes. Upon detection of a jam, the jam detector associated with a moved entry finger directs the timing circuit to pulse the solenoid so that the pusher fingers will be rotated to their second or inoperative orientation. When rotated to their second orientation, the pusher fingers are no longer in the vicinity of the group of items, thereby lessening the potential for damage to the items during withdrawl of the carriage.

As many as five pusher fingers are selectively attachable to the carriage for shoving items of different sizes into open envelopes. The pusher fingers have a unique profile for contacting a group of items as the item lie on an insertion plate at the insert station. The pusher fingers are accommodated in but do not contact corresponding grooves in the insertion plate.

In order to lessen the tendency for rapidly inserted items to bounce out of an opened envelope, the envelope opening station is provided with inertia retarding means in the form of a brush mounted so that bristle tips thereof contact a panel of the envelope positioned in the envelope opening station. The bristle tips of the brush serve to dampen the momentum of items being inserted into the opened envelope.

Should a jam occur in the process of inserting a group of items into an opened envelope, access can readily be obtained to the location whereat the jam occured. To obtain such access, the carriage and its associated carriage guide can be rotated upwardly about an axis proximate the rear of the insertion station. Moreover, a gate comprising the envelope opening station can be unlatched and swung about an axis which lies in a plane perpendicular to the plane in which the unenvelope lies. Thus, the gate can swing frontwardly away from the location whereat at the jam occurs, thereby providing easier access to the jam location.

Once an envelope has been stuffed with a group of items, the travelling flap of an open envelope strikes a trip member comprising an envelope presence detector assocated with an envelope sealing station. In timed relation with the detection of the presence of the envelope at the envelope sealing station, atomized fluid is discharged from a pair of spaced-apart nozzles so that the fluid is applied along spaced-apart paths of travel of the envelope flap, and in particular is directed toward gummed regions on the interior of the envelope flap.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
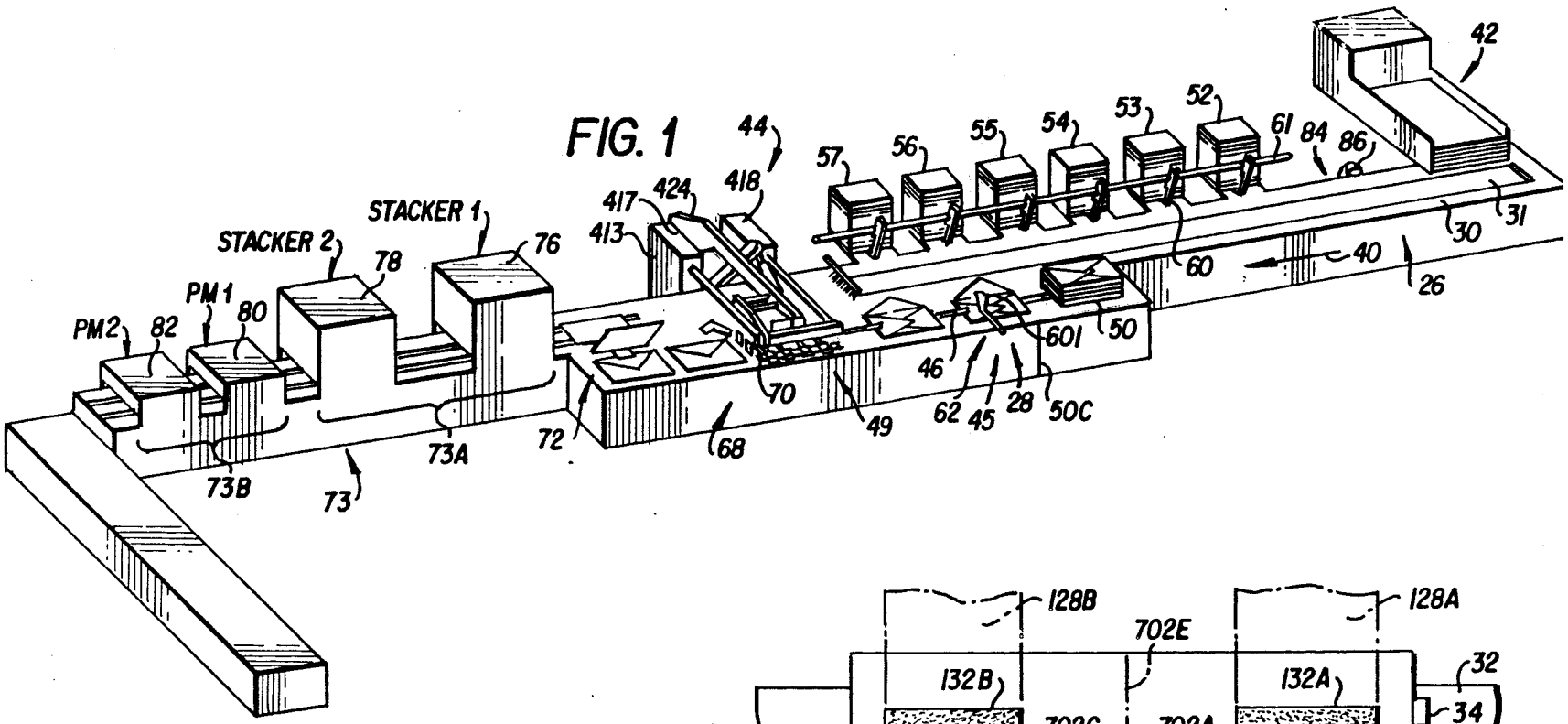
FIG. 1 is a front isometric view of portions of an insertion machine system according to an embodiment of the invention.

FIG. 1 illustrates an insertion machine system according to an embodiment of the invention. The embodiment of FIG. 1 comprises a back table portion 26 and a front table portion 28. The back table portion 26 includes an essentially linearly-extending insert track 30 which extends along a series of insert processing stations. The insert track 30 has sets of conveys groups of documents deposited thereon in the direction of arrow 40 from an upstream-most insert station 42 to an insertion or envelope stuffing station 44. In contrast to the timing chains heretofore used in connection with an insert track, the insert track 30 of the embodiment of FIG. 1 includes continuous belt 32. The continous belt is made of an elastomeric material, such as rubber, for example. The belt 32 has pairs of upstanding pusher pins 34 mounted therein at equally spaced intervals which serve to push inserts deposited onto belt 32 in the direction of arrow 40.

Figure 9A:
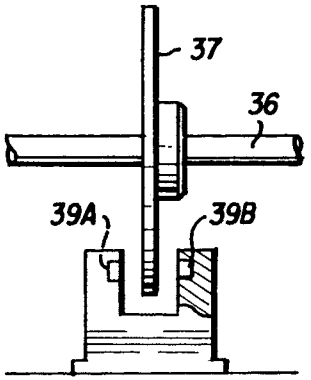
FIGS. 9A and 9B are side and front views, respectively, of machine cycle detection means according to the embodiment of FIG. 1.
Figure 9B:
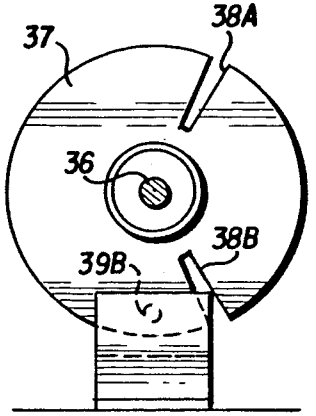

The insert track 30 is indexed once per machine cycle in a manner well known in the prior art. In this respect, it is understood that the entire insertion machine is driven by an unillustrated motor. The motor is coupled both to a continuously rotating main timing shaft 36 (see FIGS. 9A and 9B) and to an intermittently rotating shaft (unillustrated). One full rotation (i.e. 360°) of the continuously rotating main timing shaft 36 is referred to as a machine cycle. The main timing shaft 36 has a plurality of timing discs mounted thereon, such as disc 37 (the function of which is explained hereinafter). Disc 37 has circumferential slits 38A and 38B thereon. The rotatable disc 37 is centrally mounted on the main timing shaft 36 so that slits 38A and 38B permit the passage of light from a source 39A to a detector 39B twice per machine cycle, particularly at zero degrees of the machine cycle (0 DMC) and 160 DMC.

The belt 32 is suitably connected to the intermittently rotating shaft by means well known to those skilled in the art whereby the belt 32 is moved during a portion of the machine cycle. In the embodiment described herein, the belt 32 is essentially stationary through 0 DMC to 180 DMC and moves essentially from 180 DMC to 360 DMC for incrementally advancing documents. It should be understood, however, that the particular degree of machine cycle at which belt 32 moves differs slightly in some embodiments in view of various acceleration and deacceleration factors.

An envelope track 45 extends on the front table portion 28 in parallel manner along-side at least a portion of the insert track 30. The envelope track 45 has gripping jaws 46 formed on an indexing chain 48 whereby the envelope track 45 pulls an envelope deposited thereon also in the direction of arrow 40 away from an envelope feed processing station 50 and to an envelope opening processing station 49. The envelope opening processing station 49 is located on the front table 28 directly in front of the insertion station 44.

The front table portion 28 has associated therewith a continuously rotating timing shaft and an intermittently rotating shaft. In differing embodiments these two shafts associated with the front table portion 28 are coupled directly to the machine motor as described above or are mechanically linked to the continuously rotating main timing shaft and to the intermittently rotating shaft described above which operates chain 31. The intermittently rotating shaft associated with the front table portion 28 is used to incrementally advance the envelope indexing chain 48.

The series of insert processing station includes the first or up-stream most insert station 42, as well as the second, third, fourth, fifth, sixth and seventh insert stations numbered 52 through 57, respectively. The first insert station 42 is a cuttertype insert station which includes a web cutter of the type marketed by the FIMA Corporation. The insert station 42 cuts documents from a web of documents; collects the cut documents in sub-groups in a collection stage; and, discharges sub-groups onto the insert track 30 generally at a rate of one sub-group per machine cycle.

The insert stations 52 through 57 are each gripper-type insert stations having oscillating gripper arm structure. In a gripper insert station, a gripper arm 60 mounted on an oscillating shaft 61 extending above the insert track oscillates the gripper arms toward and away from a hopper (denoted by reference numerals 52H–57H) associated with the insert station. The gripper arm has two jaw members which selectively engage a vacuum-deflected document in the insert station hopper at an appropriate point in the machine cycle and which, after the gripper arm has oscillated away from the hopper, selectively disengage the document, thereby depositing the document on the insert track.

The processing stations located along the envelope track 45 include the afore-mentioned envelope feed processing station (also known as the envelope hopper) 50, an envelope flap opener processing station 62, and the envelope opening station 49. The envelope feed processing station 50 can, in differing embodiments, include any one of a plurality of types of envelope feeding mechanisms.

The insertion station 44, described in more detail hereinafter, serves to stuff a group of related documents into an awaiting, opened envelope.

A sealing processing station 68 is situated immediately after the insertion station 44. The sealing station 68, described in more detail hereinafter, comprises a flap moistening means 70 which moistens a gummy seal-portion of a moving envelope flap prior to the flap being rotated back to its closed position.

Although not illustrated for sake of clarity, a protective hood overlies much of the insert track 30, insert stations 52 thorugh 57, insertion station 44, and sealing processing station 68.

Downstream from the sealing station 68 is an envelope turnover processing station 72 which, in a manner well known in the prior art, during four sequential machine cycles flips an envelope from envelope track 45 into a front panel-up orientation on an exit conveyor 73. The mechanical mechanism which performs the turnover or flip operation is mechanically linked to the machine timing shaft.

The exit conveyor of the embodiment of FIG. 1 comprises a first segment 73A and a second segment 73B. Segment 73A, which extends beneath two diversion processing stations such as stackers 76 and 78, is a chain-indexed conveyor driven in a manner similar of the insert track 30. Examples of diversion stackers of the type shown in FIG. 1 are described in U.S. Pat. No. 3,652,828 to Sather et al. Segment 73A discharges stuffed envelopes onto segment 73B. Segment 73B is a continuously running conveyor which extends along two postage meter processing stations 80 and 82.

INSERT TRACK STRUCTURE

Figure 2:
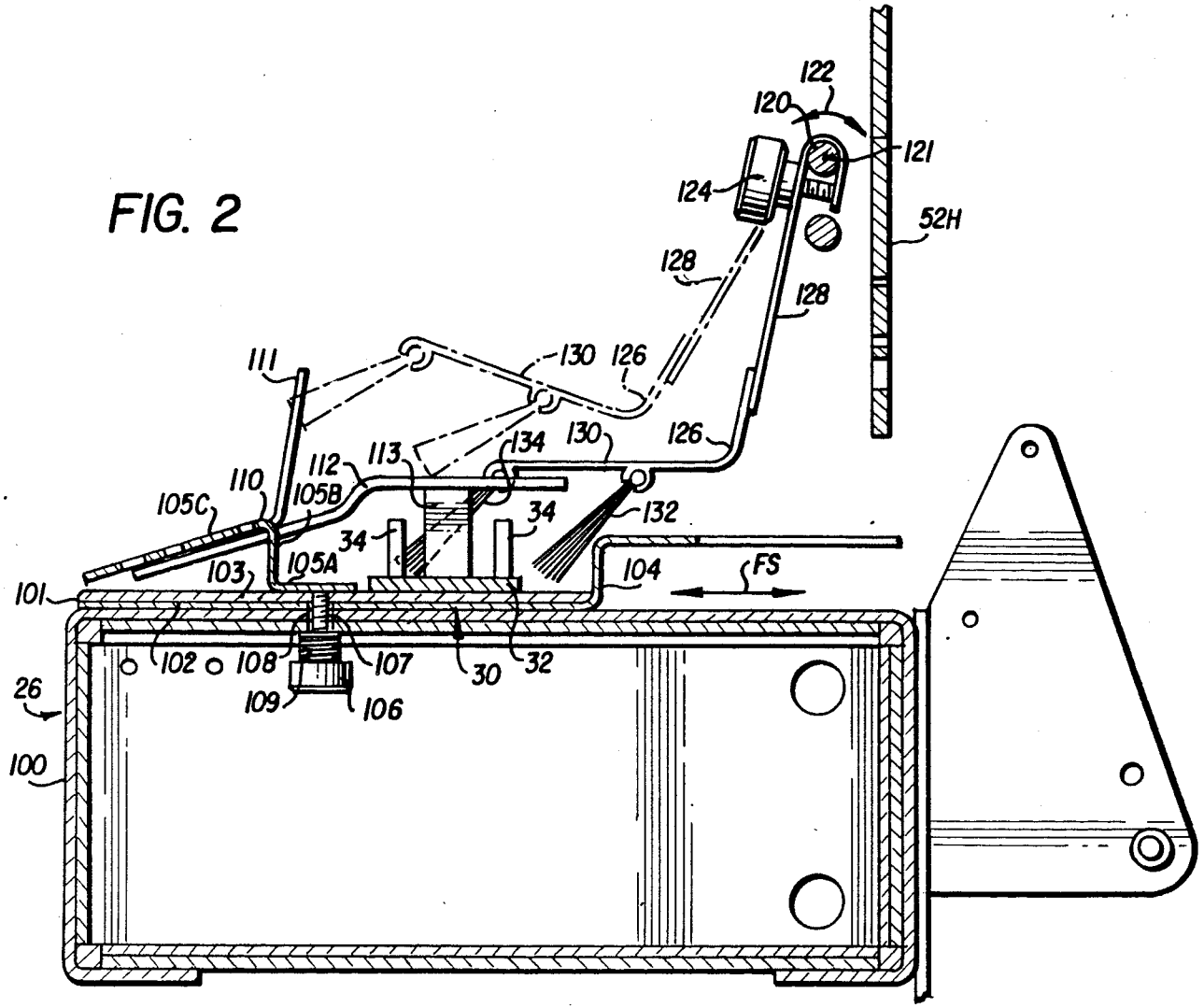
FIG. 2 is a cross sectioned left side view of a back table portion of an insertion machine system according to the embodiment of FIG. 1.
Figure 3A:
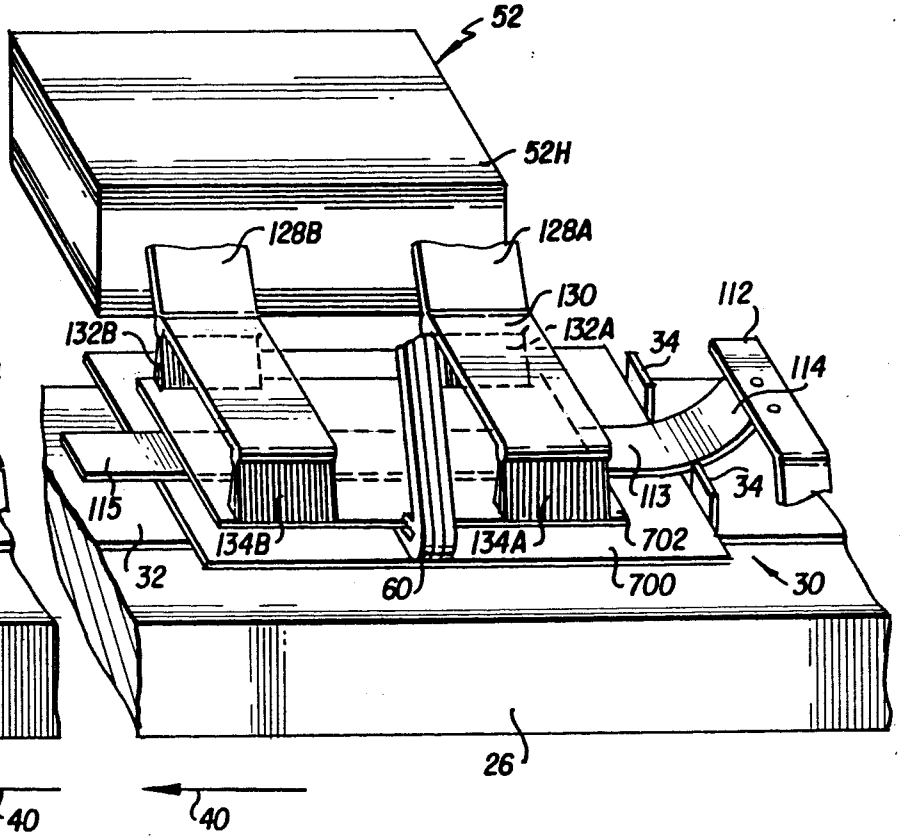
FIGS. 3A and 3B are front isometric views depicting, during consecutive machine cycles, differing portions of a back table of an insertion machine system according to the embodiment of FIG. 1.
Figure 3B:
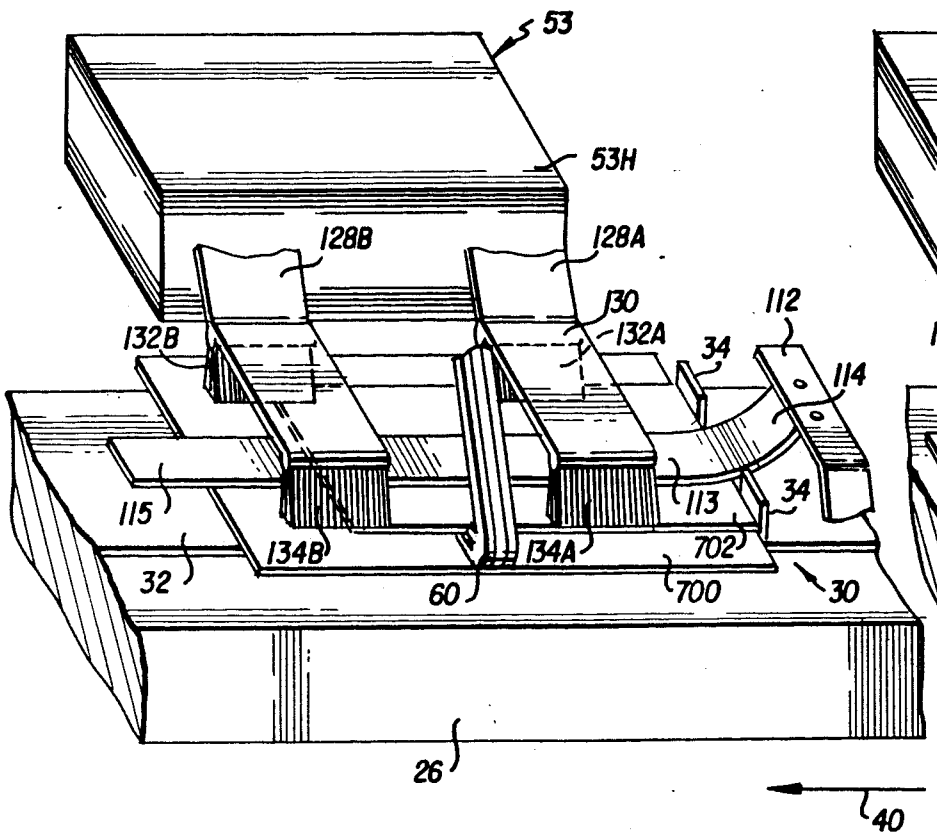

The insert track 30 and the back table 26 are shown in more detail in FIGS. 2, 3A, and 3B. A back table frame 100 is essentially rectangular in cross section as shown in FIG. 2. As shown in FIG. 2 (but not shown in FIGS. 3A and 3B for the sake of clarity), the back table frame 100 has a horizontal plate 101 lying thereon. Plate 101 is a composite which comprises an underlying sheet metal base 102 and a top surface 103. At an intermediate portion thereof, the base 102 extends perpendicularly upwardly in a vertical segment 104. The vertical segment 104 of base 102 extends above the plane of the top surface 103 to function as a track rear guide or track rear edge defining means. The top surface 103 is a ultra high molecular weight (UHMW) polyethelene. Top surface 103 is adhered to base 102 by suitable bonding means such as an adhesive. In the upper course of travel the belt 32 contacts top surface 103 of plate 101.

The back table frame 100 has a track front guide or edge defining means attached thereto in the form of track front fence 105. Front fence 105 has a horizontal segment 105A, a vertical segment 105B, and a downwardly inclined segment 105C. The underside of fence horizontal segment 105A is secured to the shank ends of a plurality of tensioned fasteners 106 situated along the length of the back table. The plate 101 has a plurality of elongated slots 107 which extend rearwardly from near the front edge of the plate 101. The shank of each fastener 106 extends through a corresponding slot 107 and through a corresponding hole 108 in the top of the back table frame. An expansion spring 109 is captured between the head of the tensioned fastener and the underside of the top of the back table frame, with the result that the plate 101 is sandwiched in a friction fit between the top of the back table frame and the track fence segment 105A. In its friction fit, with some effort the plate 101 is slidable in the direction depicted by arrow FS in FIG. 2.

As shown in FIG. 2 (but not in FIGS. 3A and 3B), at spaced intervals perforations 110 are provided along the track front fence 105 in the bend region between fence segments 105B and 105C. Secured to the underside of the inclined fence segment 105C are both a plurality of spaced-apart posts 111 and a plurality of spaced-apart branch members 112. From their points of connection to the underside of the inclined fence segment 105C, posts 106 extend through various ones of the perforations 110 and then are angled essentially vertically. The branch members similarly extend through various ones of the perforations 110 from whence they are oriented in the manner hereinafter described.

Branch members 112 are positioned to be suspended above and across the width of the belt 32. That is, branch members 112 extend essentially perpendicular to the direction in which belt 32 moves. Each branch 112 is associated with one of the insert stations 52 through 57. Moreover, each branch 112 is positioned just slightly upstream from the location at which the pusher pins 34 pause for receiving an insert fed from the associated insert station.

An elongated strip 113 is fastened beneath each branch member 108 proximate the midpoint of the width of belt 32. The strip 113 is preferably formed from a plastic material, such as polyvinyl chloride (PVC), for example. Each strip 113 has its axis of elongation parallel to the direction of travel of the belt 32. An upstream portion 114 of each strip 113 is connected to an underside of branch 112 and thus is elevated above the belt 32. From its connection to branch 112, the upstream portion 114 curves downwardly towards the belt 32 to form an essentially horizontal downstream portion 115 which gently rides on the belt 32. The horizontal downstream portion 115 extends to a location just short of the branch member associated with the next downstream insert station.

Suspended above and running the length of the portion of the back table 26 which expands the insert stations 52 through 57 is a rocking rod 120. Rocking rod 120 has an axis 121 which is parallel to the direction of arrow 40. The axis 121 of rod 120 is between the belt 32 and the hopper for any of the stations 52 through 57. Rod 120 rotates through an angular displacement of about 15 degrees (in the direction of arrow 122).

Locked onto rocking rod 120 by fastener means 124 are a plurality of knock-down arms 126. Two such arms 126A and 126B are associated with each of the insert stations 52 through 57. Each knock-down arm 126 has a slightly inclined vertical portion 128 and an essentially horizontal portion 130 which extends at least partially over the insert track 30. In accordance with the rotation of rocking rod 120, each knock-down arm 126 rotates from a first position (at which a knock-down arm 126 is shown in broken lines in FIG. 2) to a second position (at which a knock-down arm 126 is shown in solid lines in FIG. 2).

A pair of insert inertia dampeners are affixed beneath the horizontal portion 130 of each knock-down arm 126. In the illustrated embodiment the insert inertia dampeners comprise a pair of bristled brushes including a first brush 132 and a second brush 134. The first brush 132 of each pair is positioned so that the bristled tips thereof are suspended in the path of insert travel between the track rear guide 104 and the rear-most pusher pin 34 when the knock-down arm 126 is in its second position. The second brush 134 of each pair is positioned so that the bristle tips thereof are suspended essentially at the center of the width of the belt 32 when the knock-down arm 126 is in its second position.

The knock-down arms 126A, 126B associated with each insert station are positioned on opposite sides of the feeder means, such as gripper arm 60, associated with that insert station. Knock-down arm 126A (with brushes 132A and 134A depending therefrom) is situated upstream of gripper arm 60 while knock-down arm 126B (with brushes 132B and 134B depending therefrom) is situated downstream of gripper arm 60. As seen hereinafter, the knock-down arms 126A, 126B associated with each insert station function to direct an insert toward the insert track 30. The brushes for contacting the insert are discontinuous, there being four separate brushes—brushes 132A, 134A, 132B, and 134B—at each insert station.

INSERTION STATION STRUCTURE

The insertion station 44 comprises an insertion station frame 200; a carriage 202 which carries a plurality of pusher fingers 204; pusher finger orientation control means 205; carriage drive means 206; a drive linkage 208; and, carriage guide means 210.

Figure 4:
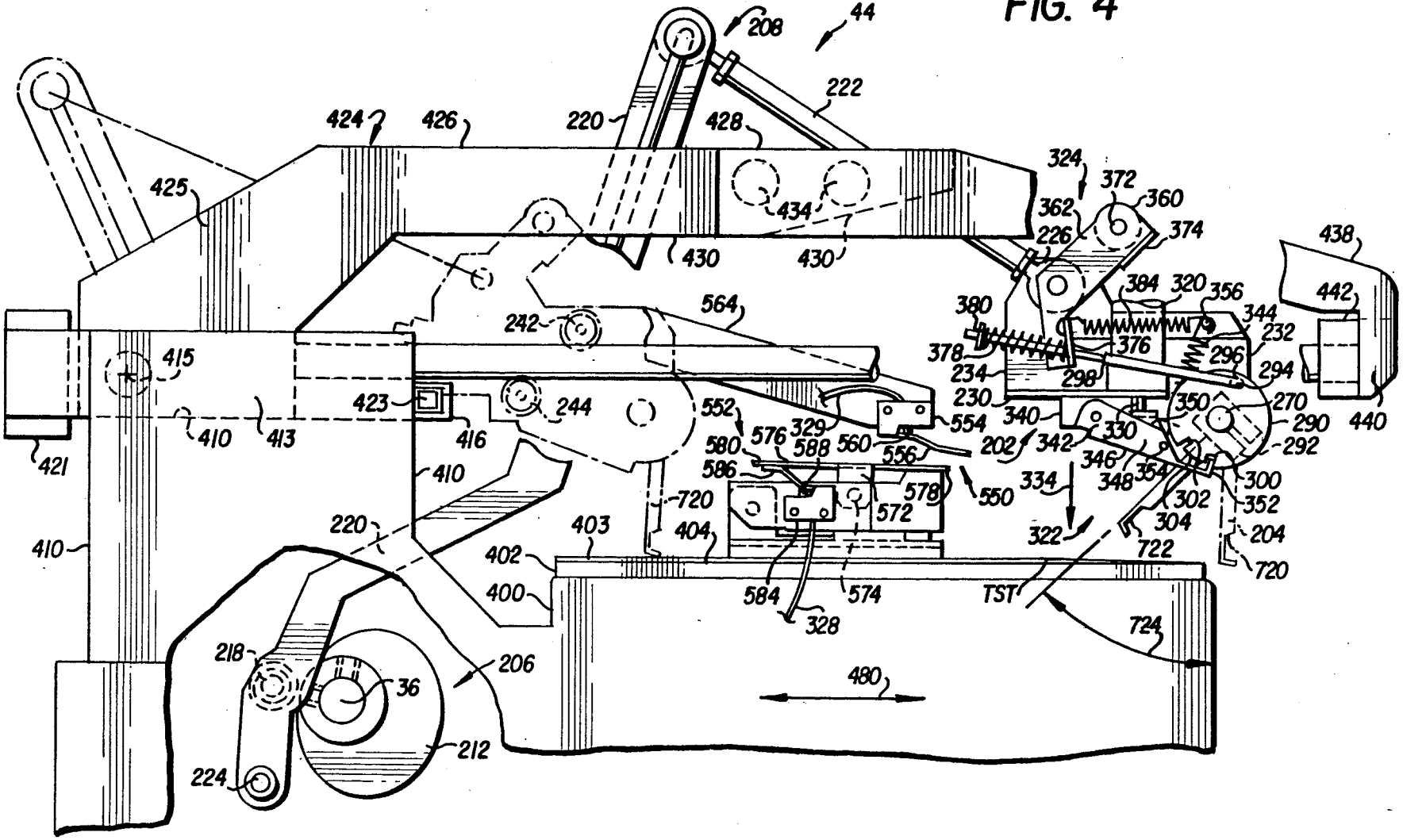
FIG. 4 is a left side view of an insertion station included in an insertion machine system according to the embodiment of FIG. 1.

The carriage drive means 206 comprises a cam 212 mounted on the insertion machine main timing shaft 36 (see FIG. 4). As seen hereinafter, the profile of cam 212 determines during which portion of a machine cycle the carriage travels in a rightward direction in FIGS. 4 and 5 (that is, toward the envelope opening station 49) and during which portion of a machine cycle the carriage travels in a leftward direction in FIGS. 4 and 5 (that is, away from the envelope opening station 49). In this regard, in FIG. 4 carriage 202 is shown at its right-most extent of travel while a broken line representation of the profile thereof shows the left-most extent of travel of carriage 202.

The drive linkage 208 comprises a cam follower roller 218; a pivoting linkage arm 220; and, a linkage rod 222. As shown in FIG. 4, the linkage arm 220 pivots about point 224 and carries cam follower roller 218. The pivoting linkage arm 220 is resiliently biased by an unillstrated spring such that the cam follower roller 218 mounted thereon is always in contact with the periphery of cam 212. An end of the pivoting linkage arm 220 opposite its pivotal connection to the insertion machine frame has a first end of the linkage rod 222 rotatably coupled thereto. A second end of the linkage rod 222 has a coupling 226 which is rotatably connected to the carriage 202 in the manner hereinafter described.

The carriage 202 includes a horizontal base plate 230 (having a front edge 232 and a back edge 234); a left side plate 236; and, a right side plate 238. Each carriage side plate 236, 238, has front edges and back edges, the front edges of which extend beyond and below the front edge 232 of the carriage base plate 230.

A roller bracket 240 is welded to the exterior of the carriage left side plate 236. The roller bracket 240 carries two rod-following rollers, particularly an upper roller 242 and a lower roller 244. Each roller 242, 244, is rotatably mounted on respective shafts 246, 248 with shafts 246 and 248 being perpendicularly connected to a bracket 240 in such a manner that the upper roller 242 is disposed closer to the front of the carriage 202 than is the lower roller 244.

A stationary shaft 260 is carried between the rear edges of the carriage left side plate 236 and the carriage right side plate 238. The shaft 260 has two cylindrical sleeves 262, 264, concentrically mounted thereover with a gap provided between the sleeves 262 and 264. The gap accommodates the second end of the linkage rod coupling 226 which is rotatably connected to the shaft 260 at the location of the gap.

A pusher finger shaft 270 is rotatably carried on the carriage 202. Near their front edges and below the base plate 230, the carriage side plates 236, 238 have apertures therein sized to accommodate bearings 272 through which the pusher finger shaft 270 extends. An intermediate section of the pusher finger shaft 270, i.e. about ⅓ of the overall length of the pusher finger shaft 270, is located between the carriage side plates 236 and 238. The pusher finger shaft 270 has five chordal grooves 274 provided therein in spaced-apart manner along the length of shaft 270 to accommodate five respective pusher fingers 204. Each of the five pusher fingers 204 is selectively connected by an appropriate fastener 278 to the chordal groove 274 of the shaft 270. Thus, depending on the size of items to be inserted into an envelope, an operator can select how many pusher fingers 204 are required to perform the insertion and attach the selected number of pusher fingers 204 to shaft 270 using the fasteners 278.

The pusher finger shaft 270 also has a pusher finger latch cam 290 centrally mounted thereon to rotate with the pusher finger shaft 270. The pusher finger latch cam 290 is essentially disk-shaped and carries a clamp 292 by which it is attached to the pusher finger shaft 270. The pusher finger latch cam 290 has an aperture 294 proximate its upper circumference through which a first or hooked end 296 of a pusher finger reset link 298 extends. Along a segment of its lower circumference the pusher finger latch cam 290 is provided with two spaced-apart notches 300 and 302. An .arc 304 between the notches 300, 302 has a radius from the center of the pusher finger latch cam which is slightly less than the radius of the remainder of the circumference of the pusher finger latch cam (excepting the two notches).

The carriage 202 at least partially carries the pusher finger orientation control means 205. The pusher finger orientation control means 205 comprises timing means, such as timing circuit 306 (see FIG. 17); actuator means, such as solenoid 320; a pusher finger latch assembly 322; and, a pusher finger reset assembly 324 (also known as pusher finger orientation determination means).

Figure 17:
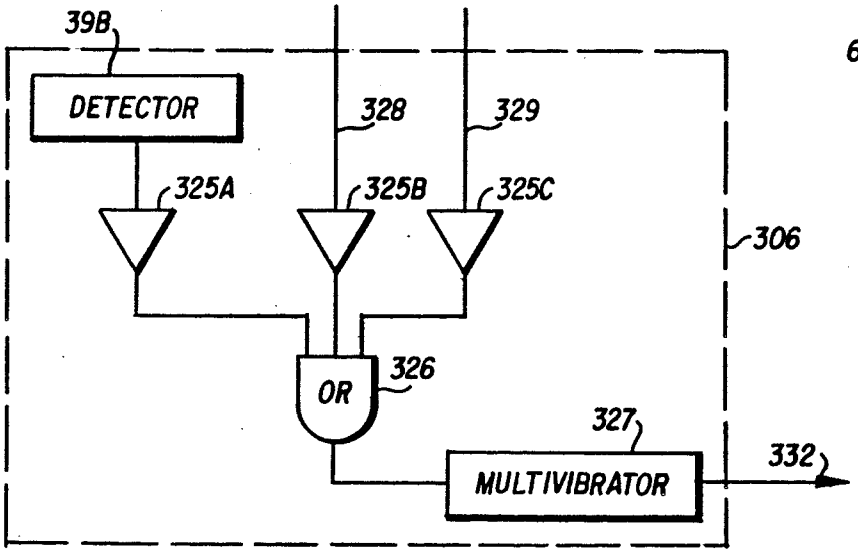

The timing circuit of FIG. 17 comprises the photodetector 39B; operational amplifiers 325A, 325B, and 325C; an OR GATE 326; and, a multivibrator 327. An output terminal of the photodetector 39B is connected to an input terminal of OP amp 325A. An input terminal of OP amp 325B is connected by a line 328 to a microswitch associated with a left jam detector described hereinafter. Likewise, an input terminal of OP amp 325C is connected by a line 329 to a microswitch associated with a right jam detector described hereinafter. The output terminals of the OP amps 325A, 325B, and 325C are each connected to an associated input terminal of the OR gate 326. An output terminal of OR gate 326 is connected to an input terminal of the multivibrator 327. The multivibrator 327 is of a type that creates a pulse at an output terminal thereof upon receipt of a true signal from OR gate 326.

The solenoid 320 is mounted on the carriage base plate 230 proximate an intermediate portion of the front edge 232 thereof. At the location on the carriage base plate 230 whereat the solenoid 320 is mounted, the carriage base plate 230 has an aperture formed therein to accommodate a solenoid plunger 330. The plunger 330 is capable of extending through the aperture and beneath the base plate 230. The solenoid 320 is connected by an appropriate insulated electrical cable 332 to the output terminal of multivibrator 327 of timing circuit 306. When the solenoid 320 receives a signal via cable 332, the plunger 330 moves further downwardly in the direction of arrow 334. Absent such a signal, the plunger 330 is in the position shown in FIG. 4.

The pusher finger latch assembly 322 is mounted essentially beneath the base plate 230 of the carriage 202. The pusher finger latch assembly 322 comprises a pusher finger latch block 340; a latch member 342; and, a latch return spring 344.

The pusher finger latch block 340 is connected to depend from the bottom of the carriage base plate 230. Latch member 342 has a base portion 346; two upstanding edge flanges 348; and, a plateau portion 350 carried on the base portion 346 intermediate the two edge flanges 348. Near their rear extremities the edge flanges 248 are pivotably mounted to depend from the pusher finger latch block 340. The base portion 346 of the pusher finger latch assembly protrudes beyond the edge flanges 348 to form an upturned hook 352 which is selectively engagable with notches 300, 302 formed on the pusher finger latch cam 290. The plateau 350 is positioned to be beneath the solenoid plunger 330 so that, when the solenoid 320 receives a signal, the plunger 330 depresses latch member 342 in the direction of arrow 334, whereby the latch member 342 rotates in the clockwise direction as shown in FIG. 4 about the point at which the edge flanges 348 are pivotably mounted to the block 340.

The leftmost edge flange 348 on the pusher finger latch member 342 has an aperture 350 through which extends the first end of the latch return spring 344. The second end of the latch return spring is engaged with a horizontal anchoring post 256 which extends from the left side plate 236 of carriage 202 near the upper, front end of the left side plate 236.

The pusher finger reset assembly 324 comprises a pusher finger reset follower roller 360; a bracket 362 upon which the follower roller 360 is rotationally carried; and, the pusher finger reset link 298. The pusher finger reset bracket 362 comprises spaced apart left and right members 364, 366, respectively mounted to rotate about shaft 260. At their upper end the members 364, 365 have roller 360 rotationally mounted therebetween on a shaft 372. Proximate their top ends the members 364, 366 are connected together by a bridge 344.

Figure 6:
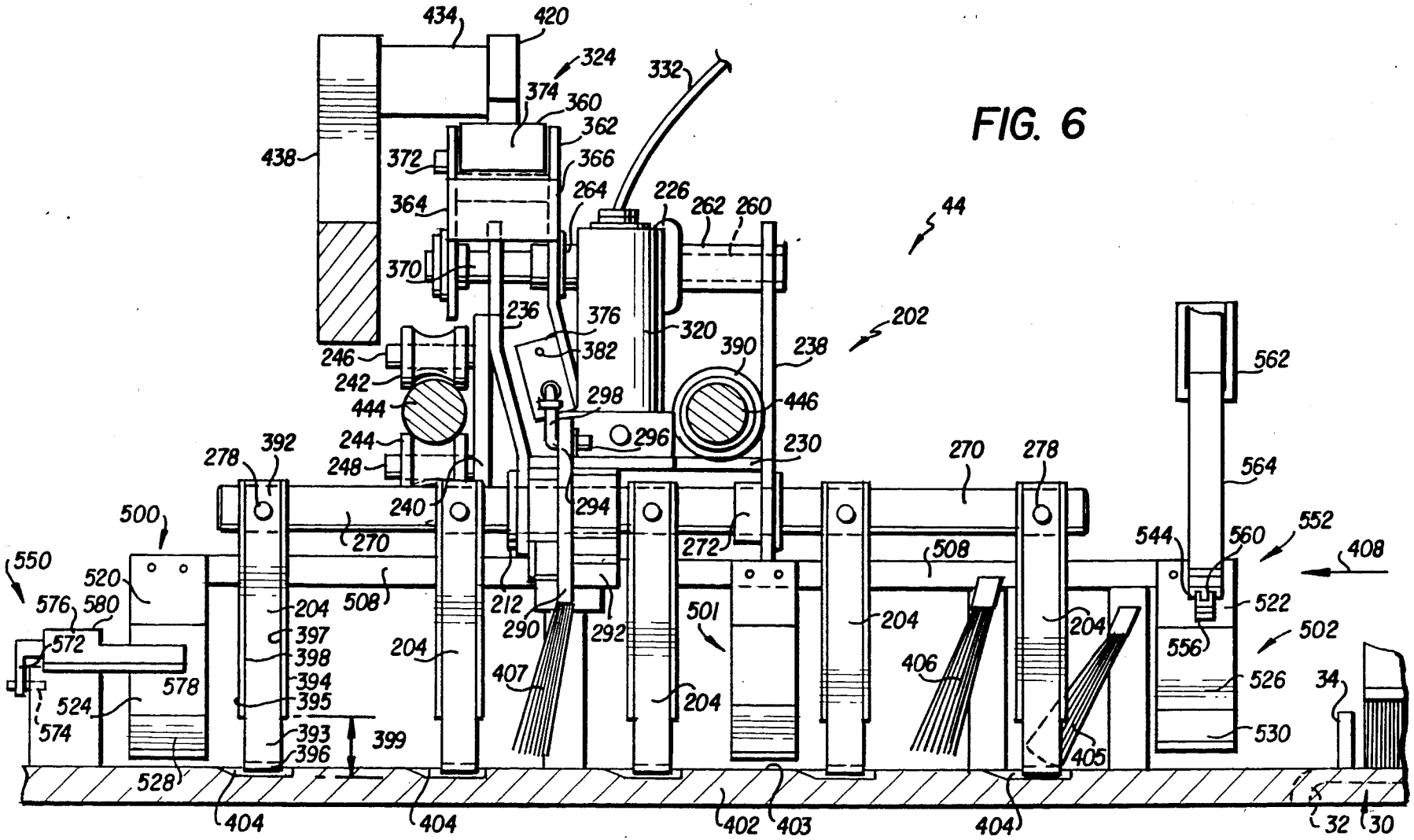
FIG. 6 is a front view, partially sectioned, of the insertion station of FIG. 5 taken along the line 6—6.

As shown in FIG. 6, the right side member 366 of bracket 362 depends lower than the left side member 364 and has a flange 376 extending perpendicularly therefrom. Flange 376 has a lower aperture through which an intermediate portion of the pusher finger reset link 298 extends. A forward portion of the pusher finger reset link 298 engages the aperture 296 on the pusher finger latch cam 290. A rear end of the reset link 298 has a pusher finger lowering spring 378 carried thereon between a stop 380 and the flange 376. The flange 376 also has an upper aperture 382 through which a first end of a pusher finger raising spring 384 extends. A second end of the pusher finger raising spring 384 is engaged to the anchoring post 356 on the carriage 202.

The pusher finger lowering spring 378 serves to urge the pusher fingers 204 to a first of lowered orientation. The pusher finger raising spring 384 serves to urge the pusher fingers 204 to their second or raised orientation. Which of the springs 378 or 384 prevails in urging the pusher fingers 204 to an orientation is determined by carriage location determination means 386. As seen hereinafter, the carriage location determinator 386 includes a ramp surface extending over only a portion of the extent of travel of the carriage 202 and the aforedescribed pusher finger reset follower roller 360.

The carriage 202 also carries a cylindrical bearing 390. The cylindrical bearing 390 is mounted on the carriage 202 in a corner between the right side plate 238 and the horizontal base plate 230.

As shown in FIG. 6, each pusher finger 204 has an essentially rectangular planar portion having a first end 392; a second end 393; and, two sides 394 and 395. Each pusher finger 204 is connected at its first end 392 to the shaft 270 by the fastener 278. At its second end at 293 the pusher finger 204 has an out-turned flange 396 formed thereon to face the front of the insertion station (i.e., towards the envelope opening station 49). The two sides 394, 395 each have out-turned flanges 397, 398, respectively, formed thereon, which side flanges 397, 398 commence proximate the first end 392 of the pusher finger and which terminate a predetermined distance 399 from the second end 396. The predetermined distance 399 is chosen to size the gap suitable for accommodating therein the edges of a sufficient number of items.

The insertion station frame 200 includes a table 400 which is included as part of the insertion machine back table 26. The table 400 has an insertion plate 402 mounted thereon. The insertion station frame 200 is positioned such that the insertion plate 402 is directly downstream from the insert track 330 so that items carried by the belt 32 are pushed by pusher pins 34 directly onto the top of the insertion plate 402. As seen in FIG. 4, at point TST the top surface 403 of the insertion plate 402 is slightly inclined with respect to the horizontal. That is, at point TST the top surface 403 is slightly higher than at its front termination at the envelope opening station 49.

Figure 5:
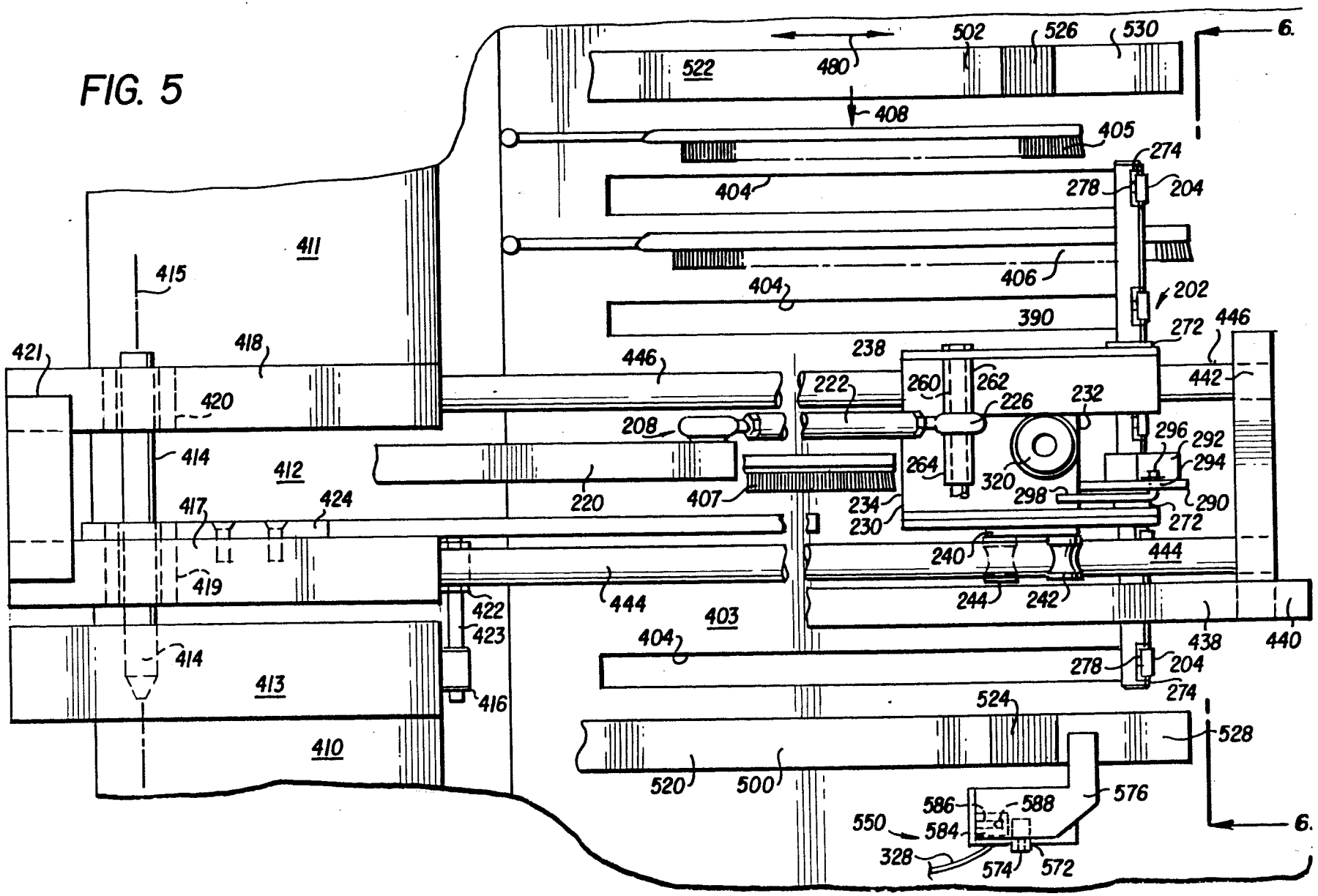
FIG. 5 is a top view of an insertion station included in an insertion machine system according to the embodiment of FIG. 1.

As seen in FIGS. 5 and 6, the insertion plate 402 has five grooves 404 formed therein. Each groove 404 is formed beneath the course of travel of an associated pusher finger 204 and accommodates therein the distal flange 396 of the associated pusher finger 204. As shown in FIG. 4, the bottom of each groove 404 is essentially horizontal, and commencing at point TST the plate top surface 403 is slightly angled with respect to the horizontal. As a result, commencing at point TST the depth of each groove 404 with respect to the top surface 403 decreases the closer the groove 404 approaches the envelope opening station 49 (i.e., the groove 404 tapers to become more shallow as the groove 404 extends rightwardly as shown in FIG. 4).

As also shown in FIGS. 5 and 6, a plurality of insert inertia dampening means, particularly brushes 405, 406, and 407, extend above the insertion plate 402. The brushes 405, 406, and 407 are held aloft over the insertion plate 402 by virtue of their mounting to respective vertical posts 405A, 406A, and 407A positioned at the rear of the insertion plate 402. The brushes extend essentially orthogonally to the direction of arrow 408. Arrow 408 represents the direction of travel of a group of inserts from the insert track 30 into the insertion station 44.

Proximate the rear of the insertion station 44 are two plateaus, particularly left plateau 410 and right plateau 411. An essentially rectangular valley 412 is formed between the plateau 410, 411. Cam 212 resides deep in the valley 412, which also partially accommodates the linkage arm 220.

A shoulder block 413 is rigidly mounted on plateau 410 proximate the valley 412. Near its rear the shoulder block 413 rigidly holds a shaft 414 which extends across the valley 412. As seen hereinafter, shaft 414 forms an axis 415. At its front the should block carries a locking bracket 416.

Two rectangular arm blocks, particularly left arm block 417 and right arm block 418, are rotatably mounted by virtue of bearings 419, 420, respectively, to the shaft 414. At their rear the arm blocks are connected by an arm bridge 421. At its front the left arm block carries a locking bracket 422.

Figure 11A:
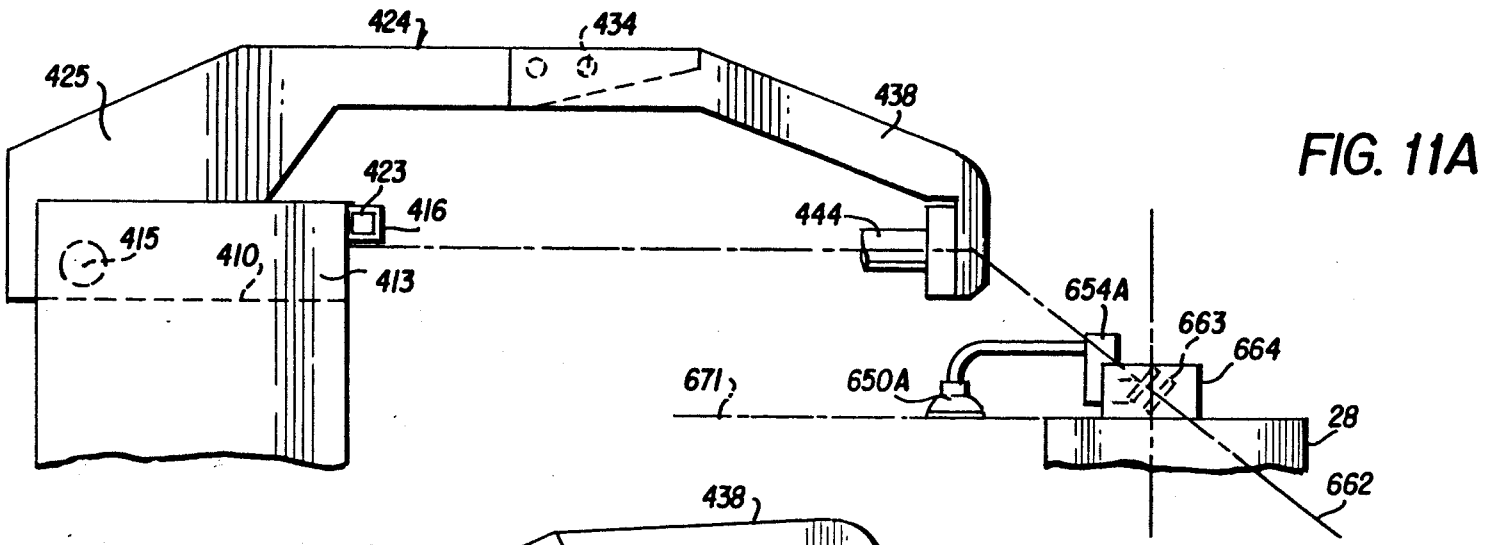
FIGS. 11A and 11B are side schematic views of portions of an insertion station and portions of an envelope opening station of the insertion machine of the embodiment of FIG. 1 in operational positions and in clearance positions, respectively.

Both locking bracket 416 mounted on shoulder block 413 and bracket 422 mounted on arm block 417 have rectangular channels therein which are alignable with one another for receiving a locking bar 423. When locking bar 423 extends through both brackets 416 and 422, the arm blocks 417 and 418 are locked into an essentially horizontal position about axis 415. When arm blocks 417 and 418 are thus locked into such a horizontal position as shown in FIG. 11A, the carriage 202 operates in its normal position to reciprocate back and forth in a horizontal path to the envelope opening station 49. When locking bar 423 is withdrawn from locking brackets 416 and 422, the arm blocks 417 and 418 are free to rotate about axis 415 through an angle theta to a second or clearance position for facilitating access to the envelope opening station 49.

The left arm block 417 has a pusher finger reset ramp 424 connected an interior vertical face thereof by means of bolts. As shown in FIG. 4, the ramp 424 has an angled back portion 425, an essentially horizontally-extending portion 426, and a forward portion 428. The bottom of the ramp horizontal portion 426 and the bottom of the ramp forward portion 428 form a ramp surface 430 which is contactable by roller 360 during part of the course of travel of roller 360 from the front to the rear of the insertion station 44. This ramp surface 430 is included in the aforementioned carriage location determinator 386.

Near its forward portion 428 the pusher finger reset ramp 424 has two essentially horizontally oriented, cylindrical bridging posts 434 by which a first end of a span member 438 is connected to the ramp 424. A second end of the span member 438 terminates over the envelope opening station 49 in an essentially vertically oriented nose portion 440. The back of the nose 440 has a rectangular essentially horizontal member 442 extending rightwardly from the nose 440. The rectangular member 442 is adapted to securely receive a pair of guide rods, particularly a left guide rod 444 and a right guide rod 446. The left guide rod 444 extends from its anchorage at the left arm block 417 to the left side of the rectangular member 442. The right guide rod 446 extends from its anchorage at the right arm block 418 to the right side of the rectangular member 442.

Carriage 220 is so positioned with respect to the guide rods 444, 446, that the upper roller 242 travels on top of the left guide rod 444, and the lower roller 244 engages the bottom of the left guide rod 446. Likewise, the carriage 202 is so positioned with respect to the guide rod that the right guide rod 446 extends through the cylindrical bearing 390. Extending thusly, the guide rods 444, 446 form linear path defining means for the linear reciprocation of carriage 202. In this respect, the guide rods 444, 446 guide the carriage 202 so that the carriage travels in the direction shown by arrow 480.

Figure 7:
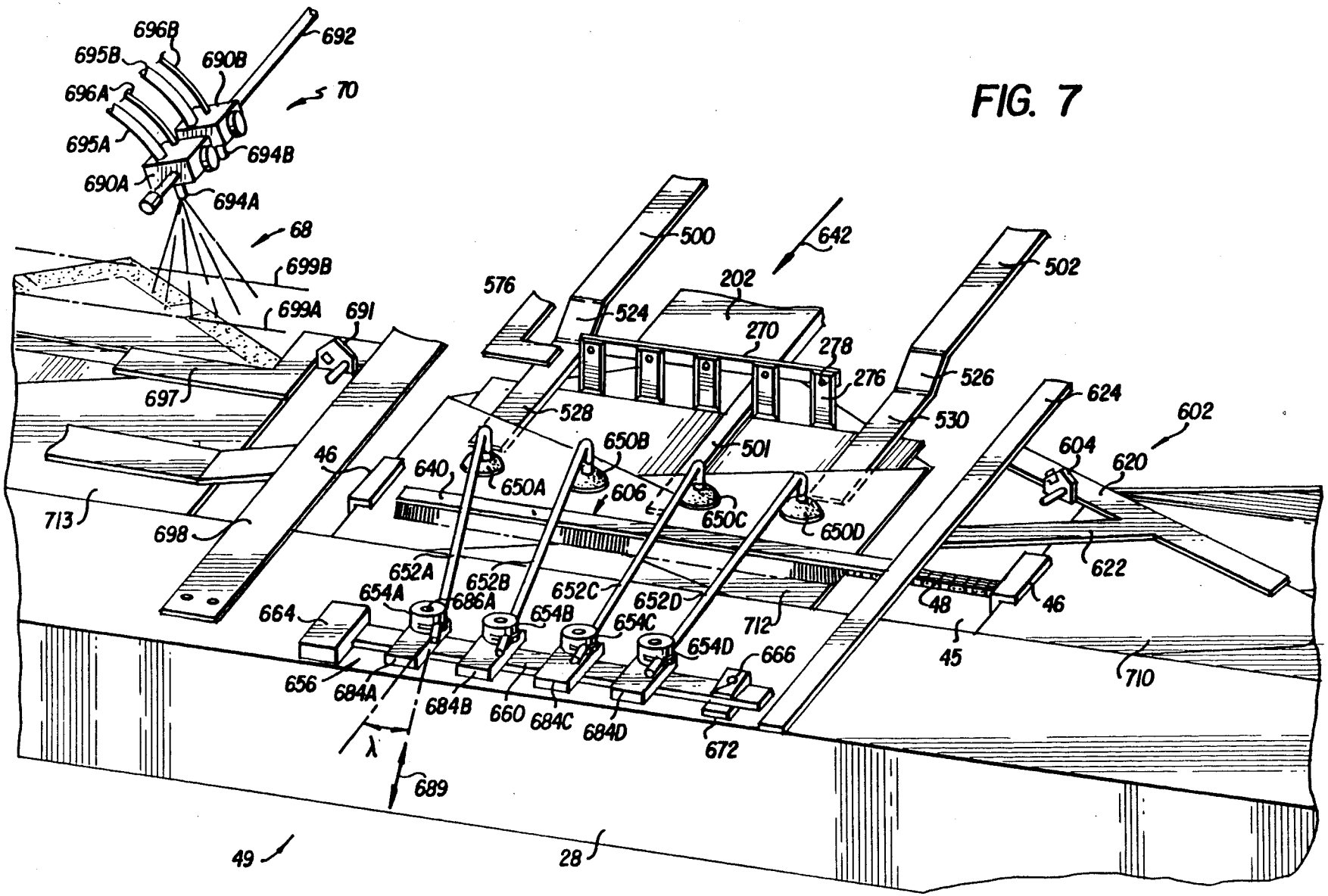
FIG. 7 is a front isometric view of an envelope opening station of an insertion machine system according to the embodiment of FIG. 1.

As shown in FIGS. 5, 6, 7, 15, and 16, a plurality of entry fingers, particularly left entry finger 500, central entry finger 501, and right entry finger 502, are provided at the insertion station 44. For sake of clarity, the central entry finger 501 is not shown in FIG. 5. The entry fingers 500, 501, 502 are provided with distal ends which facilitate insertion of a group of items into an opened envelope by extending over the items to keep the items low with respect to the insertion plate 402. The elongated entry fingers 500, 501, 502 are parallel to one another and extend parallel to the direction of travel of the carriage as indicated by arrow 480. The outer entry fingers 500, 502 are spaced apart sufficiently for the carriage 202 (including pusher fingers 204 mounted thereon) to be accommodated between the entry fingers 500, 502. As shown in FIGS. 6 and 7, the central entry finger 501 extends under the carriage 202.

Figure 16:
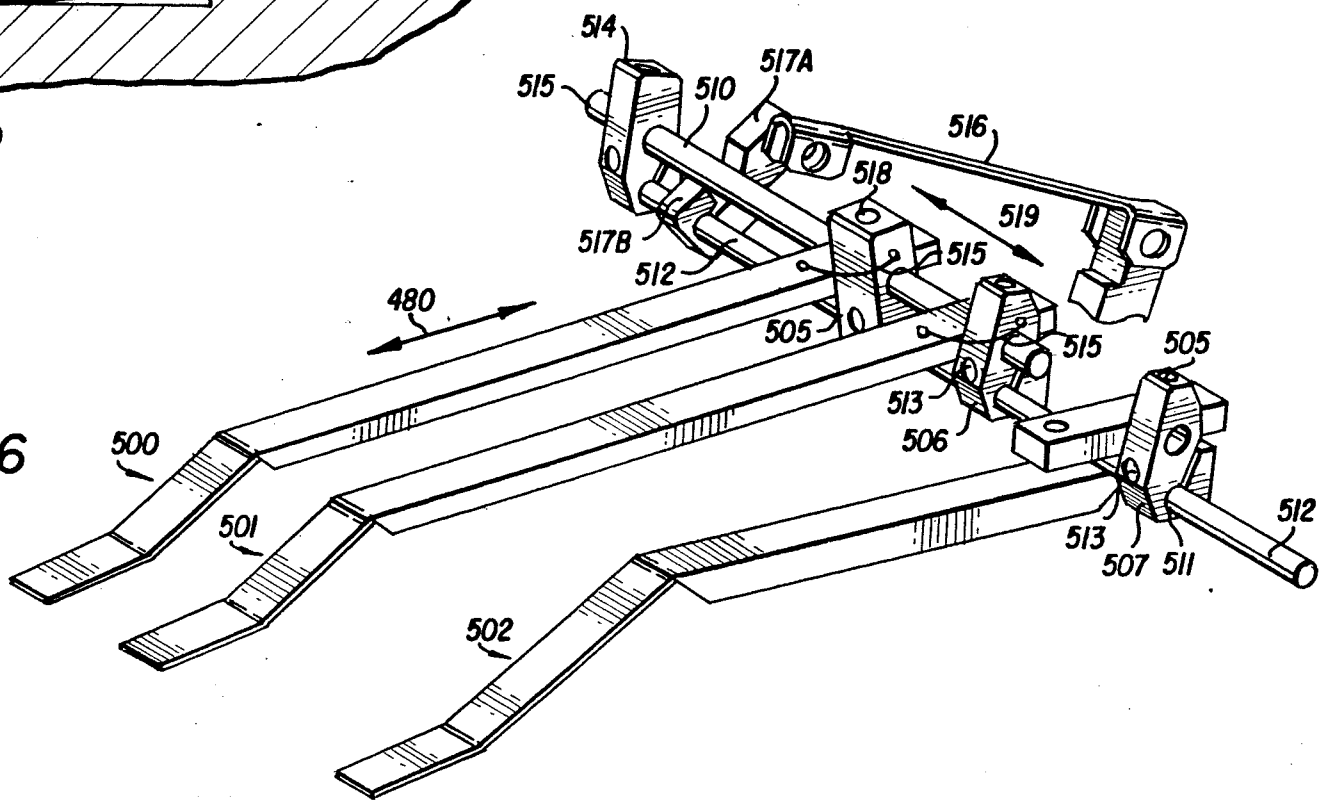
FIG. 16 is a right side perspective view of portions of an entry finger assembly included in an insertion station of the insertion machine of the embodiment of FIG. 1; and, FIG. 17 is a schematic view of a timing circuit included in an insertion machine of the embodiment of FIG. 1.
Figures 14A, 14B, 14C, 15:
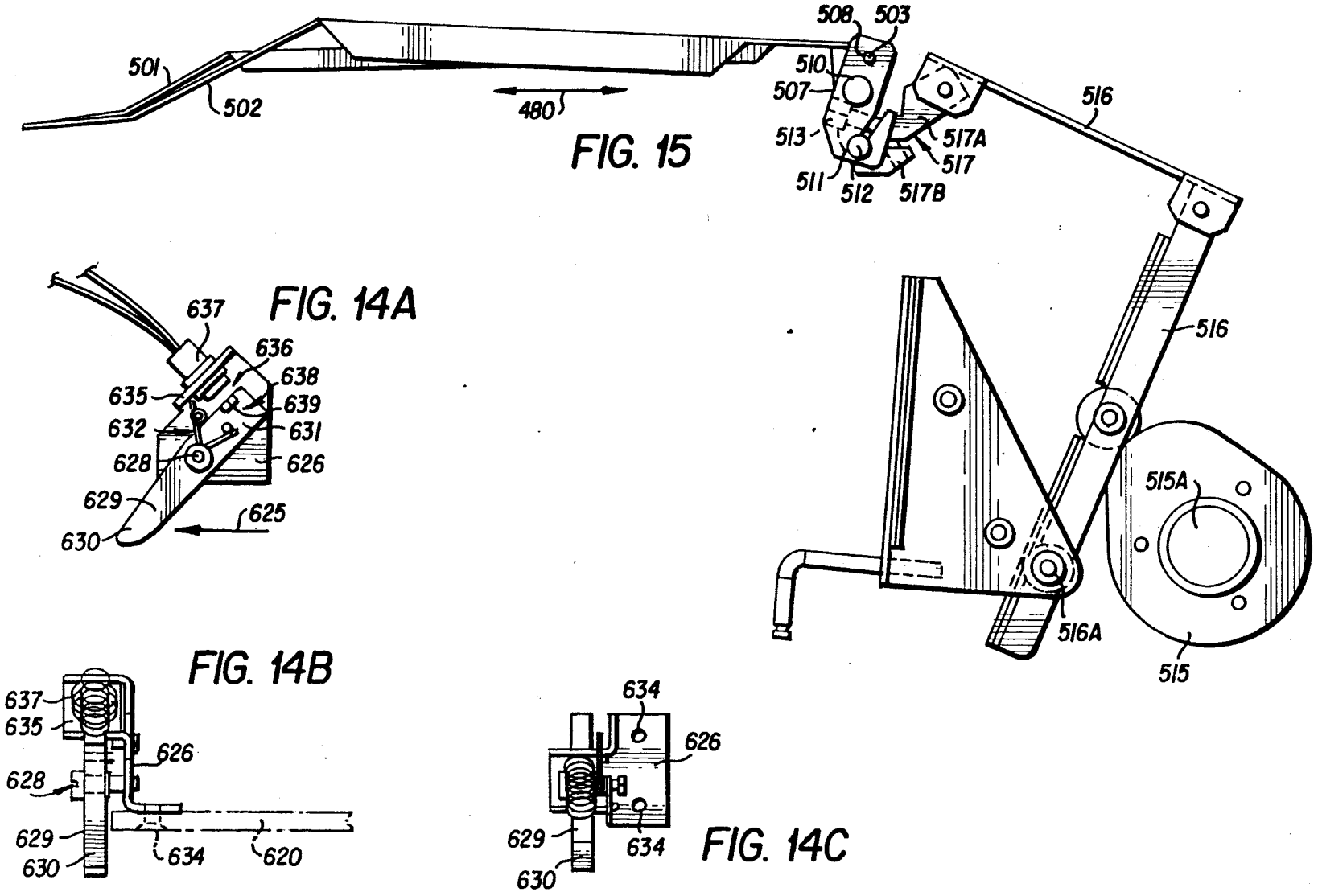
FIGS. 14A, 14B, and 14C are front, right side, and top views, respectively, of an envelope detector mechanism which comprises the insertion machine of the embodiment of FIG. 1.
FIG. 15 is a right side view of an entry finger assembly included in an insertion station of the insertion machine of, the embodiment of FIG. 1.

The entry finger assembly is seen in FIGS. 15 and 16. At their proximal ends, the entry fingers 500, 501, 502 have apertures vertically extending therethrough for rotatably accommodating a first segment of a doll pin 503. The entry fingers 500, 501, and 502 have rocker arms 505, 506, and 507, respectively, associated therewith.

Each rocker arm 505, 506, and 507 has three apertures extending therethrough: an upper aperture 508 through which a second segment of the doll pin 503 extends; a central aperture 509 sized to accommodate a rotatable entry finger position adjustment shaft 510; and, a lower aperture 511 through which a rotatable rocking rod 512 extends. Each rocker arm 505, 506, and 507 is clamped onto rotatable rocking rod 512 by a clamping fastener 513.

A support rocker arm 514 also has the rotatable rocking rod 512 and the adjustment shaft 510 extending therethrough. Retaining rings 515 are employed outboard of the support rocker arm 514 and the rocker arm 506 to retain the shaft 510 from axial displacement. Shaft 510 does not extend through aperture 509 in rocker arm 507.

The rocking rod 512 is mounted on the insertion plate 402 by unillustrated pillow block bearings. The entry fingers 500, 501, and 502 rock forward and backwards as the rocking rod 512 rotates. In this regard, each entry finger is biased toward its associated rocker arm by an expansion spring 515. Expansion spring 515 has a first hooked end thereof which engages a hole in the entry finger and a second end thereof which engages the rocker arm. The extension spring serves not only to bias the entry finger alongside its associated rocker arm, but also to give the entry finger a downward (i.e. counterclockwise as seen in FIG. 16) moment with respect to the doll pin 503 (about which the entry finger is pivotal), thus biasing the entry finger downwardly toward the insertion plate 402.

The rocking rod 512 is rotated by drive means shown in FIG. 15 as comprising a cam 515 mounted on a timing shaft 515A; a cam follower arm 516 pivotally mounted at point 516A to a frame; and, a rocker arm 517. The rocker arm 517 has a first end 517A thereof rotatably connected to the follower arm 516 and a second end 517B thereof clamped to the rocking rod 512.

A set screw 518 is provided on the rocker arm 505 associated with left entry finger 500. The head of the screw 518 selectively bears against the entry finger position adjustment shaft 510. After loosening the screw 518, rocker arm 505 and entry finger 500 connected thereto can be translated along shaft 510 in the direction of arrow 519 to selectively change the position of left entry finger 500 to accommodate envelopes of differing sizes.

The entry fingers 500, 502 have respective intermediate portions 520, 522 which, for the most part, extend at a very slight angle to the horizontal downwardly toward the insertion station base plate 402. Near their distal ends, however, the entry fingers 500, 502 have respective second portions 524, 526 which are more sharply inclined downwardly to the base plate 402. The entry fingers 500, 502 further have respective third portions 528, 530 which resume a slight angularly approached to the base plate 402 and which form the distal tips of the fingers 500, 502.

JAM DETECTION STRUCTURE

The insertion station 44 also includes insertion jam detection means, particularly a left jam detector 550 and a right jam detector 552. The right jam detector 552 includes a microswitch 554 having a cantilevered lever 556 and a contact end 560. The microswitch 554 is connected to frame portion 562 of the insertion machine and suspended therefrom on an arm 564 so that the microswitch lever 556 is positioned directly above the right entry finger 502. Thus, if the distal end 530 of the entry finger 502 moved or pivoted (by the jam of items therebeneath) a predetermined distance upwardly so that the top of the entry finger portion 522 pushes the microswitch lever 556 upwardly against the contact pin 560, a jam is detected at the right edge of the envelope. When contact occurs in this manner, the microswitch 554 applies a signal on line 329 to the timing circuit shown in FIG. 17.

The left jam detector 550 is movably mounted to the insertion station base plate 402 just to the left of the left entry finger 500. The left jam detector 550 comprise a block 570 movably mounted on the base plate 402. The block 570 is translatable to and away from the viewer of FIG. 4 in order to be selectively movable for a corresponding positioned adjusment with the left entry finger 500. At its left vertical side the block 570 has a bracket pivotably mounted thereabove by a pivot pin 574. Above the block 570 the bracket 572 carries a detector plate 576 which pivots in unison with the bracket 572. The deflector plate comprises a front edge portion 578 and a back edge portion 580. The front edge portion 578 of the deflector plate 576 extends laterally leftward beyond the block 570 so as to extend above the left entry finger third portion 528.

The left jam detector 550 includes a microswitch 584 mounted to the left side of the block 570. The microswitch 584 has a cantilevered lever 586 with a distal end which extends to a point just below the back edge portion 580 of detector plate 576. The microswitch 584 also includes a contact pin 588 which lies under the proximal end of lever 586 so that the contact pin 588 is depressed when the distal ends of the lever 586 is pushed downwardly by the pivotable action of plate 576 about pivot pin 574. If the distal end 528 of the entry finger 500 is moved upwardly (by the jam of items therebeneath) a predetermined distance so that the top of entry finger portion 528 pivots the plate 576 sufficiently to result in the depression of contact pin 588,.the microswitch indicates a jam at the left end of the envelope. In this regard, depression of the contact pin 588 results in the application of a signal on line 328 to the timing circuit 306 shown in FIG. 17.

ENVELOPE OPENING STATION STRUCTURE

The envelop flap opening station 62 comprises means 601 for directing a jet of air under and against the flap of an envelope just extracted from the envelope hopper 50 in order to deflect the flap to an opened position. When an envelope is in this position, a jaw 46 on the envelope chain 48 pulls the envelope into the envelope opening station 49. The envelope opening station 49, as shown in FIG. 7, includes the envelope track 45; means 602 for maintaining the envelope flap in an opened position; means 604 for detecting whether an envelope flap is in an opened position; means 606 for dampening the inertia of a group of items being inserted into an envelope; means 608 for deflecting an envelope back panel; and, means 610 for deflecting an envelope front panel.

As mentioned before, the envelope track 45 includes a chain 48 with gripper jaws 46 mounted thereon. The gripper jaws bring the envelope into the envelope opening station 49 in such a manner that the envelope lies in a horizontal plane.

The means 602 for maintaining an envelope flap in an opened position comprises an elongated flap retaining bar 620 which extends over the course of travel of the open envelope (i.e., over the inside of the envelope flap). An auxillary retaining bar 622 is connected to the elongated flap retaining bar 620 at an angle as shown in FIG. 7. The elongated flap retaining bar 620 is carried above the path of envelope travel by a bridge 624. The bridge 624 is anchored near the front edge of the front table 28.

The means 604 for detecting whether an envelope flap is in an open position is illustrated in FIGS. 14A, 14B, and 14C. With respect to FIG. 14A, an envelope travels in the direction denoted by arrow 625 from the envelope hopper 50 to the insertion station 44. Detection means 604 comprises a mounting bracket 626; a shoulder bolt 628 carried on the mounting bracket 626; an elongated trip member 629 having a first end 630 and a second end 631; torsion spring 632 for biasing the trip member 629 such that end 630 thereof is interposed in the path of travel 625 of an opened envelope flap and is strikable by the flap; and, means 633 for determining whether the electromagnetic flux density changes between the trip member 629 and a reference point changes.

The mounting bracket 626 is connected to the front and top of retaining bar 620 (shown in broken lines in FIG. 14B) by fasteners 634. A flange 635 is provided on the bracket 626. The trip member 629 is rotatably mounted to the bracket 626 about shoulder bolt 628 and is biased in the position shown in FIGS. 14 by the torsion spring 632.

The means for determining whether the electromagnetic flux density changes between the trip member 629, particularly second end 631 thereof, and a reference point comprises a magnet 636 provided on the second end 631 of trip member 629 and a Hall Effect sensor 637 mounted at the reference point on flange 635. The magnet 636 comprises a south pole 638 and a north pole 639.

Figure 8:
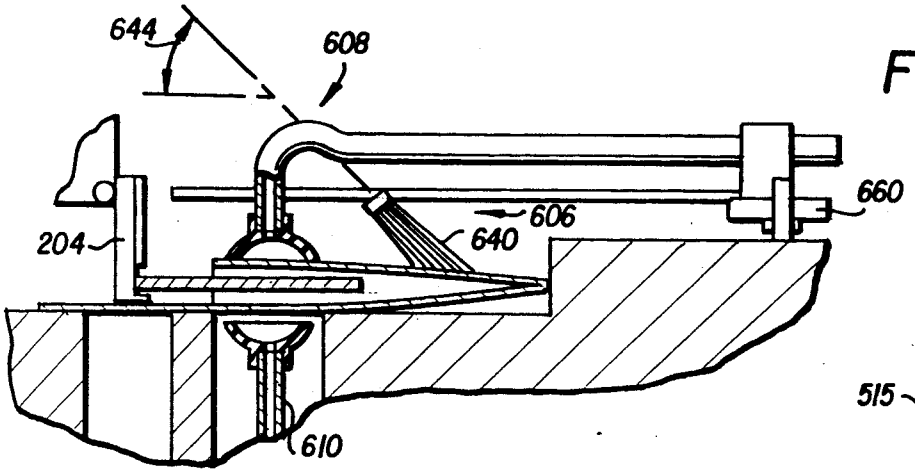
FIG. 8 is a cross sectioned left side view of an envelope opening station of an insertion machine system according to the embodiment of FIG. 1.

The means 606 for dampening the inertia of inserts being stuffed into an envelope comprises an elongated brush 640 suspended above the envelope opening station 49. The cantilevered handle of the brush 640 is connected to the bridge 624 so that the elongated axis of the brush extends parallel to the path of travel of the envelope (and hence perpendicular to the direction shown by arrow 642, the direction in which inserts are being stuffed into the envelope). As shown in FIG. 8, the brush bristles are inclined at an angle 644 relative to the horizontal and are positioned to gently rest on the top of an envelope back panel and to apply an inertia dampening force to inserts traveling therebeneath. In this regard, the angle 644 is in the range of from 15 degrees to 30 degrees.

As shown in FIG. 7, the means 608 for deflecting an envelope back panel comprises four sucker cups 650A through 650B through which vacuum is selectively applied. Each sucker cup communicates with a source of vacuum through a hollow elongated stem 652 and an unillustrated flexible hose. The elongated stem serves to position the sucker cups 650 connected to a first end thereof over the envelope back panel. Near its second end each elongated stem 652 is mounted to a vertically errect post 654. The four posts 654A through 654D are carried on a carriage means 656.

The carriage 656 includes an elongated gate member 660 which is hexagonal in cross section. Gate member 660 has a first end 661 thereof which is essentially rectangular in cross section and inclined at an angle. The first end 661 of gate 660 is pivotally attached at an axis 662 to an angled flange 663. Flange 663 is carried on a shaft 663A which rotatably extends through press sleeve bearings 663B in carriage end block 664. Carriage end block 664 is positioned on the top surface of the front table frame 28. A second end of the gate 660 carries a press sleeve bearing 665 which is selectively capturable by a gate latch assembly 666.

Gate latch assembly 666 comprises a latch block 667 having an essentially U-shaped channel 668 angularly formed therein. A base of latch block 667 is mounted by bolts 669 to the top of front table 28. Locking means, such as a spring loaded plunger 670, extends through an aperture formed in the top of the latch block 667 such that a tip of the plunger is biased into the channel 668. The channel 668 is adapted to accommodate the bearing 665 of the gate 660 therein. The biased head of plunger 670 retains the bearing 665 of gate 60 in the channel 668. The gate 660 is selectively unlocked from the latch assembly 666 by applying sufficient pressure to swing the bearing 665 of the gate 660 out of the channel 668.

When the second end of gate 660 is retained in the latch assembly 666 as during normal operation, the gate 660 and sucker cups 650 mounted thereon are positioned essentially as shown in FIG. 11A so that the sucker cups 650 can open an envelope back panel by the application of vacuum therethrough. When the second end of gate 660 is unlocked from the latch assembly 666, the gate 660 and sucker cups 650 mounted thereon are positioned essentially as shown in FIG. 11B so that access to the insertion station can be obtained, as is helpful when a jam occurs.

Figure 11B:
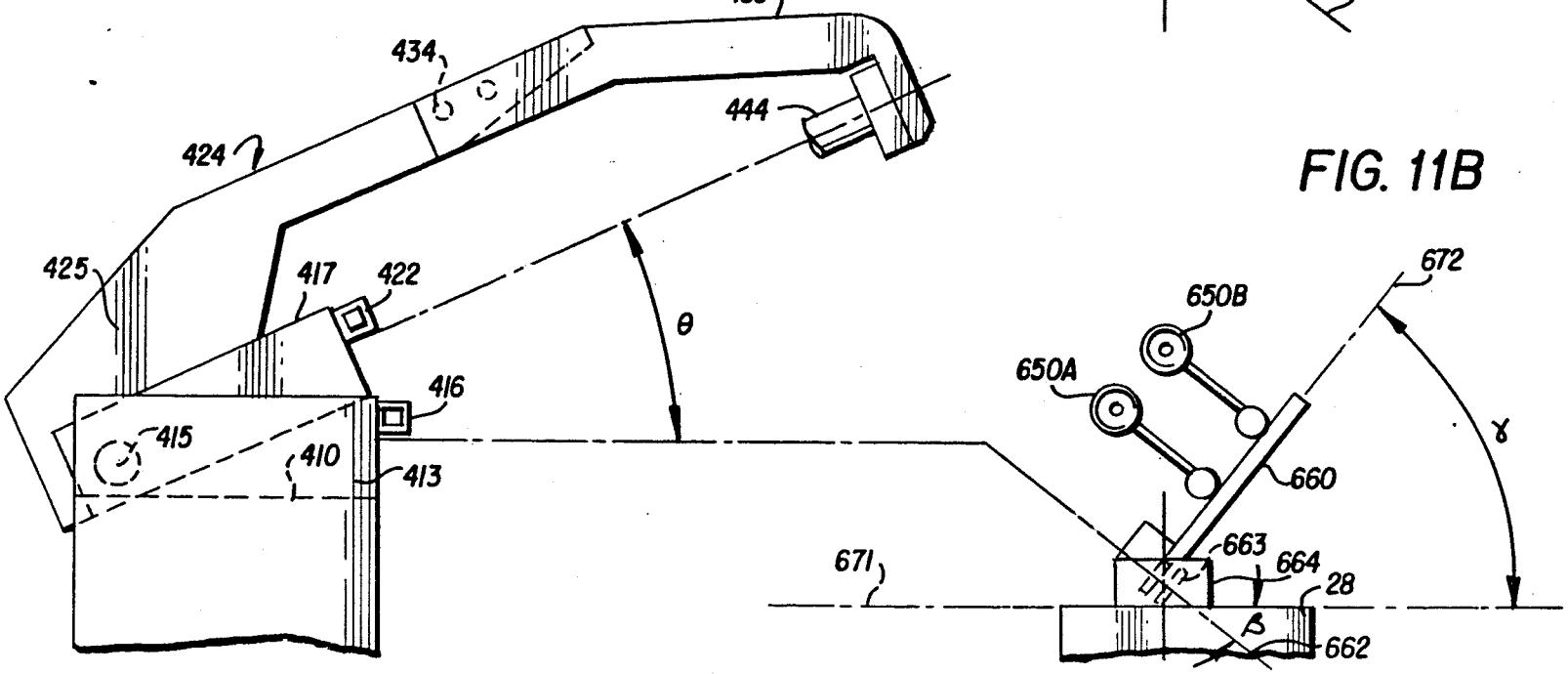
Figure 12D:
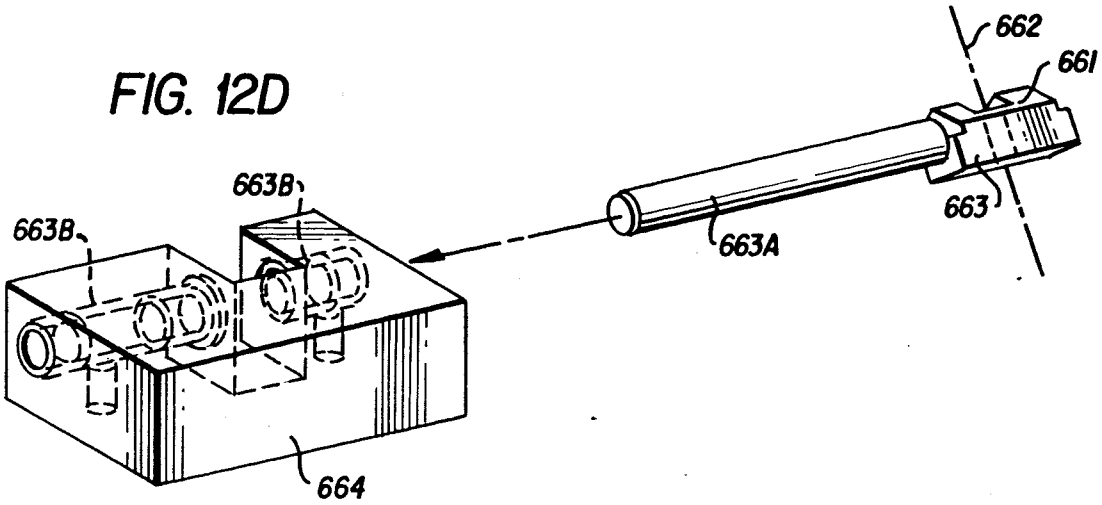
FIG. 12D is a perspective view, partially exploded, of a portion of a swinging gate assembly which comprises an envelope opening station of the insertion machine of the embodiment of FIG. 1.
Figure 13:
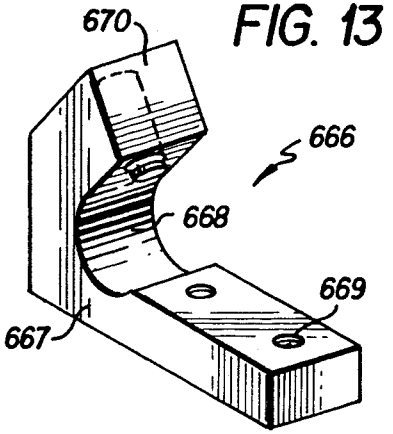
FIG. 13 is a perspective view of a gate latch assembly which comprises an envelope opening station of the insertion machine of the embodiment of FIG. 1.

In the position of the gate 660 shown in FIG. 11B, it is seen that the orientation of angled flange 663 is at an angle Beta of approximately 45 degrees with respect to the horizontal (i.e. the top of table 28). By rotating shaft, 663A using a handle sleeve 663C provided thereon, the angle Beta, and hence the orientation of flange 663 and axis 662 with respect to the horizontal, is selectively changeable.

The pivotal connection of end 661 of gate 660 facilitates the swinging of gate 660 about axis 662. Thus, when it is seen that an opened envelope into which items are to be inserted lies essentially in a plane, (the edge of which is denoted by broken line 671), and that the axis 662 lies in a second plane (i.e. the plane of the sheet of FIGS. 11A and 11B), it is understood that gate 660 is swingable about the axis 662 and that axis 662 lies in a plane that is perpendicular to the plane 671 in which the envelope lies. Moreover, with respect to the plane in which axis 662 lies, when major axis 672 of gate 660 is aligned proximate the plane of the paper of FIG. 11B, axis 672 of gate 660 is selectively orientated through a range of angles with respect to the horizontal as denoted by angle Gamma.

Figure 12A:
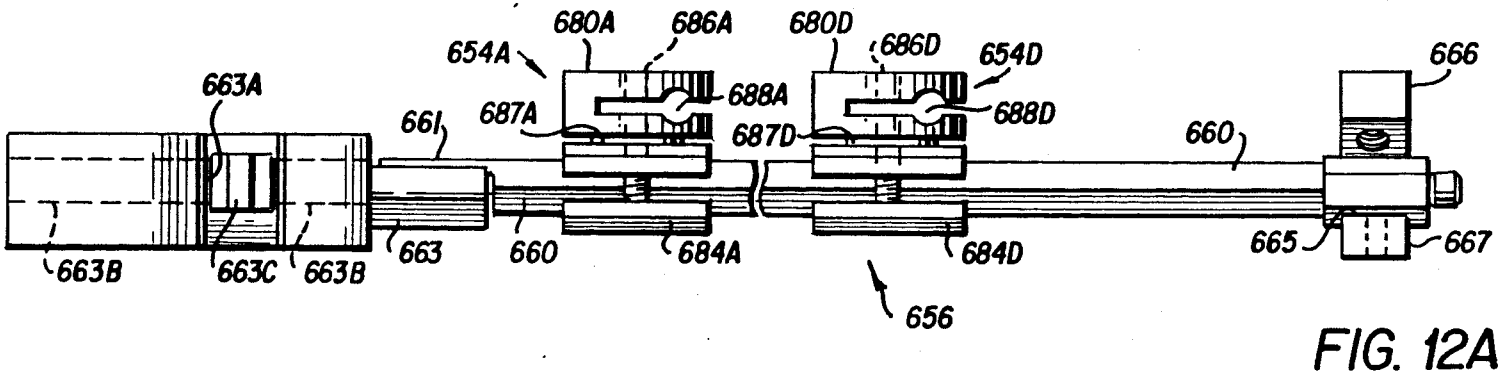
FIGS. 12A, 12B, and 12C are front, right end, and top views, respectively, of a swinging gate assembly which comprises an envelope opening station of the insertion machine of the embodiment of FIG. 1.
Figure 12B:
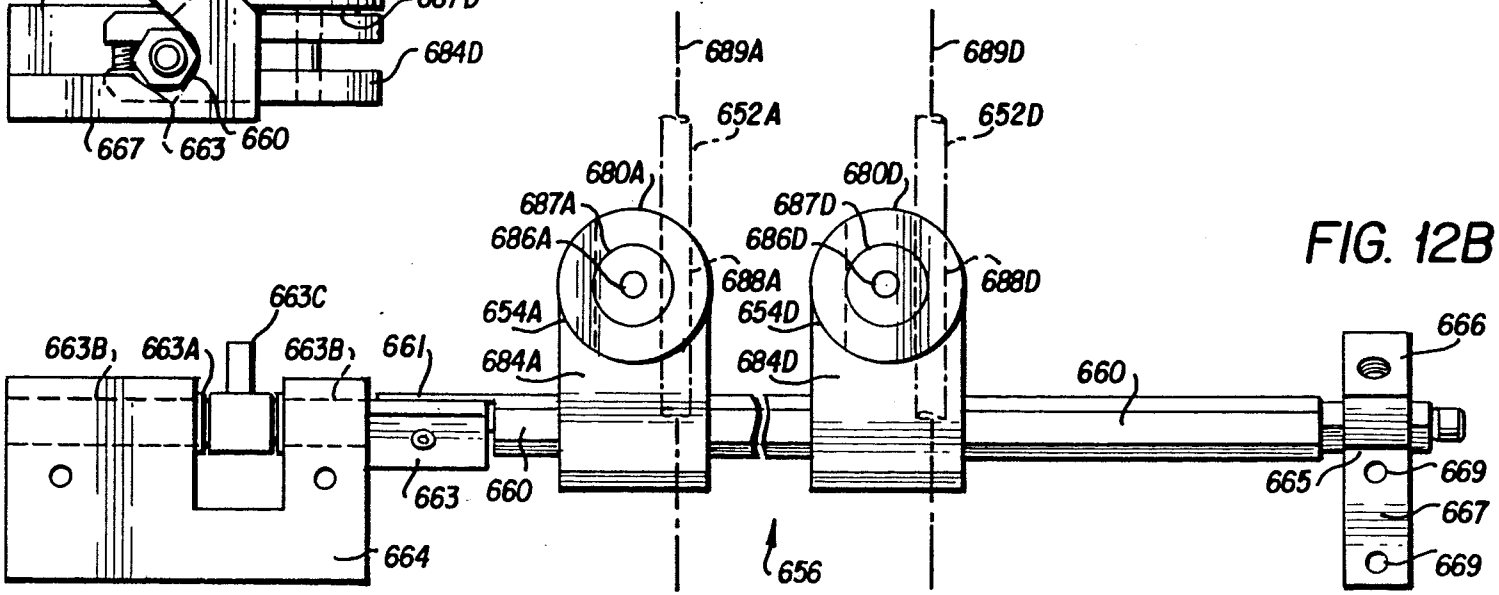
Figure 12C:
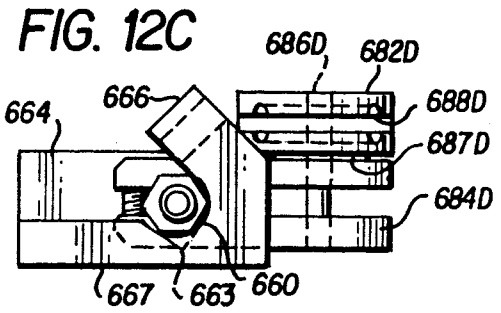

Returning now to the structure of gate 660, each vertical post 654 comprises a cylindrical knob 680 which pivotally surmounts a corresponding bracket 684. The knobs 680 are pivotally carried by corresponding brackets 684 by means of a central fastener 686 and a circular bearing 687. Each knob 680 has a channel 688 formed in chord-like fashion therein for accommodating a corresponding sucker cup stem 652 Each stem 652 can be slid with respect to its corresponding post 654 so that virtually any point along stem 652 is graspable in the post channel 688, thereby selectively adjusting the position of the sucker cup 650. Thus, the position of the sucker cup 650 can be adjusted along the axis 689 of the stem as shown in FIGS. 7 and 12C. Likewise, each sucker cup 650 can be adjusted about the axis of the post 654 by rotating the post 654 holding the stem 652 about an axis of fastener 686 so that the stem 654 is rotatable through an angle lambda shown in FIG. 7. Moreover, each bracket 684 is selectively translatable along the axis of elongation of gate 660.

The means 610 for deflecting the front panel of an envelope are not specifically discussed herein, but essentially resembles that shown in U.S. Pat. No. 2,325,455 to A. H. Williams which is incorporated by reference herein.

ENVELOPE SEALING STATION STRUCTURE

The flap moistening means 70 of the envelope sealing station 68 comprises two atomizing spray units 690A and 690B and an envelope presence detector 691. The spray units are held aloft by virtue of being mounted to a rod 692. The rod 692 is connected to the insertion machine frame. The units 690A and 690B are of a type through which atomized spray with particles on the size of 20 to 100 microns are emitted. The spray nozzles are connected by hoses 695A, 695B, respectively to an unillustrated source of fluid and by electrical lines 696A, 696B to envelope presence detector 691.

The envelope presence detector 691, shown in broken lines in FIG. 7, is mounted to the back of an elongated bar 697. Bar 697 is suspended above the path of travel of an envelope flap. Bar 697 is connected to a bridge 698. Bridge 698 is, in turn, connected to the front table 28.

The envelope presence detector 691 is of the type of detector shown in FIGS. 14A, 14B, and 14C and earlier described with reference to the envelope flap opener station 62. Thus, detector 691 has a mounting bracket which, rather than being connected to bar 620, is connected to bar 697, and has a trip member which is strikable by an opened flap of an envelope to change the detected electromagnetic flux as an indication of envelope presence. A Hall Effect sensor associated with the envelope presence detector 691 is connected so that, at an appropriate point in the machine cycle, an electrical signal is applied on lines 696A, 696B to the spray units 690A, 690B for moistening the flap of the approaching envelope. The envelope is transported past the spray units 690A, 690B by the gripping jaws 46 provided on the envelope track 45.

The units 690A and 690B are spaced apart along rod 692 so that the nozzles 694A, 694B deliver atomized fluid in spaced-apart relationship. In this respect, as an envelope is transported thereby on track 45, the nozzle 694A delivers spray at the location shown along broken lines 698A while nozzle 694B delivers atomized fluid at the location shown along broken line 698B. In this manner, when an interior flap of a large envelope has a plurality of gummed regions thereon, the spray units 690A, 690B can be spaced apart along the rod 692 in such a manner to ensure that atomized fluid is applied to each gummed region. The locations of each units 690A, 690B along the rod 692 is selectively adjustable, with the result that the flap moistening means 70 can handle a large range of envelope sizes and types.

OPERATION

Prior to the feeding of inserts from the insert stations 52 through 57, the width of the insert track 30 is adjusted to accommodate the largest of the items (also known as "inserts") to be fed from the hoppers 52H–57H associated with the stations 52 through 57. In order to adjust the width of the insert track 30, the operator slides the plate 101 either frontward or rearward along the direction depicted by arrow FS in FIG. 2. Upon the application of force in the direction of arrow FS the plate 101 is slidable by virtue of its friction fit between the fence 105 and the back table frame 100. When the plate 101 is slid rearwardly (to the right in FIG. 2), the width of the insert track 30 is broadened inasmuch as the distance between the stationary track front guide (fence 105) and the track rear guide (segment 104 affixed to plate 101) is increased. Conversely, the width of the track 30 can be narrowed by sliding the plate 101 with track rear guide 104 affixed thereto frontwardly.

Other adjustments prior to feeding of inserts include selecting a proper number of pusher fingers 204 to be mounted on carriage 202 and adjusting the position of the left entry finger 500 and the left jam detector 552. These adjustments are also based on the size of the inserts and envelopes being handled by the insertion machine. Implementation of these adjustments is understandable from the foregoing structural description.

After the preliminary adjustments have been made, the insertion machine is turned on so that the stations 42, 52 through 57 commence feeding. The first insert station 42 feeds a subgroup of items onto the insert track 30 so that the subgroup is conveyed in the direction of arrow 40 to the insertion station 44. As the subgroup is indexed toward the insertion station 44, each insert station 52 through 57 has an opportunity to feed an insert therefrom for inclusion with the subgroup.

FIG. 3A shows that a document 700 comprising a subgroup previously fed from the first feed station 44 has been indexed to a location in front of the insert station 52. When indexed to insertion station 52, pusher pins 34 move the document 700 under bridge 112 and strip 113 associated with the insert station 52. At the station 52, during an early portion of a machine cycle, the gripper arm 60 associated with station 52 extracts an item such as insert 702 from its associated hopper.

Figure 10:
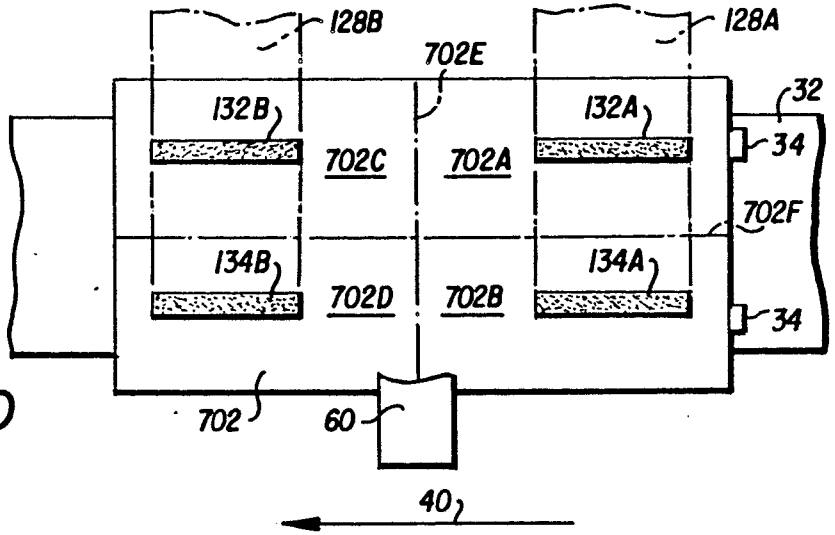
FIG. 10 is a top schematic view showing the relative position of knockdown means and portions of a document being conveyed on an insert track in an insertion machine according to the embodiment of FIG. 1.

The gripper arm 60 oscillates out over the insert track 30 with the insert 702 engaged thereby. Just prior to the time that the gripper arm 60 releases the insert 702, the two knock-down arms 126A and 126B associated with station 52 oscillate in the counterclockwise sense about rod 120 from their first position (shown in broken lines in FIG. 2) to their second position (shown by solid lines in FIG. 2). As the arms 126A and 126B oscillate, brushes 132A and 134A (depending from arm 126B) contact the top of insert 702 in the manner shown in FIG. 10. In particular, brush 132A contacts a region 702A of insert 702; brush 134A contacts a region 702B; brush 132B contacts a region 702C; and, brush 134B contacts a region 702D. These regions are defined by imaginary lines 702E and 702F. Imaginary line 702E extends from the front edge of insert 702 to the rear edge thereof to essentially perpendicularly bisect insert 702 along its length. Imaginary line 702F extends from an upstream edge of insert 702 to downstream edge thereof to essentially perpendicularly bisent insert 702 along its width.

Contact of insert 702 by the brushes 132A, 134A, 132B, and 134B of the knock-down arms assist in accomplishing several objectives including the following: (1) directing the insert 702 downwardly onto the insert track 30; (2) dampening the inertia of the inserts as they are deposited on the track 30; and, (3) preventing edges of the inserts 702 from winging upwardly about the gripper arm 60 as the insert 702 is rapidly deposited on the track 30. By controlling the inertia of the inserts and by precluding their deformation, the knock-down arms 126 facilitate precise placement of the insert upon the belt 32 so that the insert can be properly indexed downstream in a subsequent machine cycle.

The insert 702 is thus deposited on top of the PVC strip 113. When first deposited, the right edge of the insert 702 is not in contact with the pusher pins 34. In this regard, the point of deposit of insert 702 was centered with respect to gripper arm 60. Also, in this particular case, the insert 702 is relatively smaller than the subgroup 700.

During a latter portion of the machine cycle which occurs when subgroup 700 is before insertion station 52, the insert track 30 is indexed in the direction of arrow 40. As the belt 32 is indexed, the PVC strip 113 applies a frictional drag to insert 702. The drag produced by the PVC strip 113 facilitates early contact of the insert 702 by the pusher pins 34, with the result that the insert 702 has its right edge aligned with the right edge of document 700 therebeneath and in contact with the pusher pin 34 by the time the subgroup reaches the next insert station 53. The subgroup reaches the next insertion station 53 at the beginning of the next machine cycle as shown in FIG. 3B. As the group is indexed from insertion station 52 to insertion station 53, the group travels under bridge 112 and the PVC strip 113 associated with insertion station 53. The PVC strip 113 provides a frictional drag to the top of the insert 702, keeping the insert 702 essentially right-justified against the pusher pins 34.

The group comprising documents 700, 702 is indexed further downstream in the direction of arrow 40 in like manner during consecutive machine cycles. After insert station 57 has had an opportunity to feed an insert for association with the group, the belt 32 is again indexed with the result that the pusher pin 34 which has been ushering the group comprising documents 700, 702 is in the position shown in FIG. 6. When in such a position, the pusher pins 34 have essentially propelled the group of inserts in the direction of arrow 480 into the insertion station 44. As the inserts travel leftwardly into the insertion station 44 as shown in FIG. 6, the inertia dampening means comprising brushes 405, 406, and 407 serve to retard the momentum of the group of inserts with the result that the group of inserts momentarily lie on the top surface of the insertion plate 403.

At about the same time that the group of inserts is positioned before the insert station 57, an envelope is transported into position 710 at the envelope opening station 49. In this regard, the envelope at position 710, having been earlier extracted from the envelope hopper 50 by a gripper jaw 46, and having had its flap opened by a burst of air, is pulled by the envelope chain 48 in the direction of arrow 40 so that the elongated flap retaining bar 620 of the envelope opening station 49 extends over the interior of the opened flap of the envelope, thereby retaining the envelope flap in an opened position. As will be seen hereinafter, during the next machine cycle the envelope is pulled by- gripper jaws 46 into the position 712 in FIG. 7.

During the machine cycle in which a subgroup is deposited into the insertion station 44, the carriage 202 is positioned at its rear most extent of travel as shown by the broken line profile of carriage 202 in FIG. 4. At this point, the pusher fingers 204 are in a first orientation as shown by arrow 720. At about 5 DMC, the carriage drive means 206 and the drive linkage 208 cooperate together to drive the carriage 202 toward the front of the insertion station 44, that is, toward the envelope opening station 49. In this regard, the carriage travels to the front of the insertion station 44 by traveling rightwardly along the direction of arrow 480 as shown in FIG. 4. As the carriage 202 travels to the front of the insertion station 44, the insertion fingers 204 remain in the first orientation 720 whereat the distal tips 396 thereof travel beneath the top surface 403 of the insertion plate 402 and in the grooves 404. Although the pusher fingers 204 are accommodated in the grooves 404, the pusher fingers 204 do not contct the grooves 404 nor any part of the insertion plate 402. The linear path of the carriage precludes the pusher fingers 204 from bouncing with respect to the insertion plate 402.

As the pusher fingers 204 approach the front of the insertion station 44, the distal tips 396 scoop under a group of documents lying on the top surface 403 of the insertion plate 402. Essentially simultaneously therewith, the group contacts the planar portion of the pusher finger 204 in the vicinity of gap 399, the gap 399 having been sized to accommodate a group comprising a reasonable number of items. As the pusher finger 204 continue to travel rightwardly with the carriage 202 toward the envelope opening station 49, the group of items is shoved towards the envelope opening station 49.

As the carriage 202 travels towards the envelope opening station 49, the envelope is opened at station 49 by the application of vacuum through both the envelope back panel deflecting means 608 and the envelope front panel deflecting means 610.

At about 50 DMC the entry fingers 500, 501, 502, begin to reciprocate in the direction of arrow 480 toward the envelope opening station 49. At about 105 DMC the entry fingers 500, 501, 502 are positioned at their furtherest extent of travel toward the envelope station 49. At this point the distal third portions of the entry fingers extend into the envelope whose front and back panels have already been deflected. Moreover, at this point, the entry fingers extend over the group of items being shoved toward the envelope opening station 49. After 105 DMC, the entry fingers 500, 501, and 502 retreat rearwardly until they reach their full back position at 165 DMC.

At about 160 DMC the carriage 202 reaches its frontmost extent of travel as shown in FIG. 4. At this point the pusher fingers 204 are in their first orientation 402 for having completely shoved the group of items into the awaiting opened envelope positioned in location 712 of the envelope opening station 49. At 160 DMC in the machine cycle, light from source 39A is transmitted through circumferential slit 38B of timing disc 37 for reception at detector 39B. The receipt of the light at detector 39B results in the generation of electrical pulse by timing circuit 306 of FIG. 17. The pulse is applied to solenoid 320 via cable 332. For the reasons described hereinafter, the application of a pulse to solenoid 320 while the carriage 202 is at the front-most extent of its travel (at about 160 DMC) results in the rotation of the pusher fingers 204 from their first orientation 720 to a second orientation 722. As shown in FIG. 4, displacement of the pusher fingers 204 from their first orientation 720 to the second orientation 722 involves an angular displacement through angle 724, angle 724 being on the order of about 40 degrees. The carriage then travels leftwardly in the direction of arrow 480 of FIG. 4 from its front-most extent travel back to its rear-most extent of travel as shown by the broken line profile of carriage 202 in FIG. 4.

Carriage 202 repeatedly reciprocates back and forth between its front-most extent of travel and rear-most extent of travel in the above described manner by virtue of its connection through linkage means 208 to the carriage drive means 206.

Whether the pusher fingers 204 are in their first orientation 720 or in their second orientation 722 :s determined by the finger orientation control means 205 in conjunction with the particular location in which the carriage 202 is found when solenoid 320 receives a pulse. In this respect, when solenoid 320 receives a pulse, plunger 330 is depressed downwardly in the direction of 334, causing latch member 342 to rotate in the clockwise direction as shown in FIG. 4. Clockwise rotation of the latch member 342 causes its upturned hook 352 to be disengaged from whichever of the notches 300, 302 of pusher finger latch cam 290 was engaged. When the pulse applied to solenoid 320 is terminated, plunger 330 is withdrawn and the latch return spring 344 causes the latch member 342 and hook 352 carried thereby to rotate in the counter-clockwise direction. Upon rotation in the counter-clockwise direction, the hook 352 engages whichever of the notches 300, 302 happen to be proximate the hook 352. If the notch 302 is aligned to be engaged by the hook 352, the pusher fingers 204 will be maintained in the first orientation 720. If the notch 300 is in a position to be engaged by the hook 352, the pusher fingers 204 will be maintained in the second orientation 722. Whether the notch 300 or the notch 302 is in a position to be engaged by the latch hook 352 is determined by the angular position of the pusher finger latch cam 290 which, as seen hereinafter, depends upon whether the pusher finger reset follower roller 360 is following the ramp surface 430.

In the above regard, the pusher finger reset following roller 360 assumes the orientation reflected by broken lines in FIG. 4 when the roller 360 travels under the ramp surface 430. Thus, when the roller 360 is beneath the ramp surface 430, the bracket 362 upon which roller 360 is carried pivots in the clockwise sense about shaft 370 to exert a rearward pull on the pusher finger reset link 298. A rearward force acting on the pusher finger reset link 298 exerts a counter-clockwise force on the cam 290 by virtue of the engagement of cam aperture 294 by hook end 296. When a pulse is applied to solenoid 320 and the hook 352 is thereby momentarily disengaged from the cam 290, the cam 290 rotates in the counter-clockwise direction so that the hook 352 can engage the notch 302, with the result that the pusher fingers 204 assume the first orientation 720. Such occurs when the carriage 202 is at its rearmost extent of travel and when the slit 39A in the timing disc 37 transmits light to detector 39B (which occurs at zero DMC).

When roller 360 is out from beneath the ramp 430, the bracket 362 rotates about shaft 370 to assume the solid line orientation shown in FIG. 4. Counter-clockwise rotation of the bracket 362 occurs as a result of the force applied by the pusher finger raising spring 384. When the bracket 362 rotates in a counter-clockwise direction about shaft 370, the pusher finger reset link 298 (by virtue of the connection of hooked ends 296 thereof through cam aperture 294) urges the cam 290 to rotate in the clockwise sense. Hence, when a pulse is applied to solenoid 320 and plunger 330 is momentarily depressed, the cam 290 will be rotated such that notch 300 thereof can be positioned to be engaged by latch hook 352 when the solenoid pulse is terminated. When latch hook 352 engages notch 300 of cam 290, the pusher fingers 204 assume the second orientation 722 as shown in FIG. 4. Such occurs, for example, when the carriage 202 is at its front-most extent of travel and when slits 388 of timing disc 37 permits passage of light to detector 39B (which occurs at approximately 160 DMC). As described hereinafter, in like manner the pusher finger 204 assume their second orientation 722 when the follower roller 360 is out from beneath the ramp surface 430 and any one of a plurality of error conditions are detected. Such error conditions include the detection of a jam at the insertion station 44 (detected by either the left jam detector 550 or the right jam detector 552).

When a jam occurs in the insertion station 44, either the left entry finger 500, the right entry finger 502, or both entry fingers 500, 502 will be further elevated above the plane of the insertion plate top surface 403. If the left entry finger 500 is elevated in this manner, the third portion 528 thereof will contact the underside of the flange of front edge porton 578 of the detector plate 576. Contact of the underside of the detector plate 576 in this manner causes the plate 576 to rotate about its pivot point 574, thus depressing the lever 586 associated with the microswitch 584. If the lever 586 is depressed sufficiently to in turn depress the contact pin 588, the microswitch 584 generates a signal on line 590. As a result of the signal on line 560, timing circuit 306 applies a pulse on cable 332 to solenoid 330.

In connection with a jam at the insertion station 44, if the third portion 530 of the right entry finger 502 is elevated, the top of portion 522 of the entry finger 502 contacts the underside of lever 556 associated with microswitch 554, urging the lever 556 upwardly. As the lever 556 is depresses the contact pin 560, the microswitch 554 generates a signal on line 560. As a result of the signal on line 560, timing circuit 306 applies a pulse to the solenoid 320 via cable 332.

When a jam is detected at the insertion station 44, the carriage 202 will likely be positioned such that roller 360 is out from under the ramp 430, with the result that the application of a pulse to solenoid 320 will result in the movement of the pusher fingers 204 from their first orientation 720 to their second orientation 722. Rotation of the pusher fingers 204 from their first orientation 720 to the second orientation 722 is particularly strategic upon the occurrance of a jam at the insertion station 44 since the pusher fingers will then be retracted from the inserts, thereby precluding any damage to the group of inserts which otherwise might occur by continued contact with the pusher fingers 204.

Should a jam occur during the inserting of a group of items into an envelope, access to the location whereat the jam occurred can easily be obtained in the manner shown in FIG. 11B. First, the carriage 202 and the carriage guide means 210 can be rotated upwardly about axis 415 after sliding the locking bar 423 out of locking bracket 428. Second, the bearing end 665 of gate 660 can be popped out of the latch assembly 666 so that gate 660 can swing about axis 662. Gate 660 comprising the envelope opening station 49 can thus swing frontwardly away from the location whereat the jam occurred, thereby providing easier access to the jam location.

After a group of inserts is inserted in an envelope at the envelope opening station 49, the envelope is indexed to a location shown by envelope 713. The envelope track 48 causes the gripper jaw 46 to pull the envelope to the envelope sealing station 68. The presence of an envelope at the envelope sealing station 68 is sensed by detector 691 as the opened envelope flap strikes the trip member comprising the detector 691. In timed relation with the detection of the presence of the envelope at the envelope sealing station 68, atomized fluid is discharged from the nozzles 694A, 694B of the units 690A, 690B, respectively so that a fluid is applied along paths 699A, 699B, respectively, to the gummed regions on the interior of the envelope flap.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

1. An insertion machine comprising:

an envelope opening station;

means for positioning an envelope in said envelope opening station;

an insertion station positioned proximate said envelope opening station for inserting at least one item into an at least partially opened envelope, said insertion station including a carriage which reciprocates in a direction toward said envelope opening station and in a direction away from said envelope opening station, said carriage having at least one finger movably mounted with respect to said carriage for movement to a finger first orientation whereat said finger is usable for inserting an item into an envelope and for movement to a finger second orientation;

error detection means for detecting an error condition at said insertion station;

control means responsive to said error detecting means for controlling whether said finger moves to said finger first orientation or to said finger second orientation; and, means for transporting at least one item to said insertion station.

2. The apparatus of claim 1, wherein said finger control means comprises:

timing means for determining when it is permissible for said fingers to change its orientation and for generating a signal in accordance with said determination; and, finger orientation determination means for determining whether said finger should be oriented in said finger first orientation or said finger second orientation when said signal is generated by said timing means.

3. The apparatus of claim 2, wherein said finger control means further comprises:

latch means for locking said finger in a selected orientation; and, actuator means responsive to said signal generated by said timing means for facilitating unlocking said finger from said latch means.

4. The apparatus of claim 3, wherein said actuator means comprises a solenoid.

5. The apparatus of claim 2, wherein said finger orientation determination means comprises:

means for biasing said finger to its first orientation;

means for biasing said finger to its second orientation; and, means for determining which of said biasing means is to prevail in urging said finger to one of its orientations when said signal is generated by said timing means.

6. The apparatus of claim 5, wherein said means for determining which of said biasing means is to prevail comprises carriage location determination means.

7. The apparatus of claim 6, wherein said carriage location determination means comprises:

a ramp surface extending only a portion of the extent of travel of said carriage as said carriage reciprocates in said directions toward and away from said envelope opening station;

ramp follower means carried on said carriage, said follower means being biased to a follower first position whereat said follower enables one of said finger biasing means to prevail when said carriage is not proximate said ramp, said follower means being forced to a follower second position whereat said follower enables the other of said finger biasing means to prevail when said carriage is proximate said ramp.

8. The apparatus of claim 5, wherein said finger orientation determination means further comprises a rotatable axle to which said finger is attached, said rotatable axle being acted upon by both of said finger biasing means.

9. The apparatus of claim 2, wherein said timing means periodically generates signals in accordance with a machine operating cycle.

10. The apparatus of claim 9, wherein said machine operating cycle is a 360 degree cycle, and wherein said timing means generates signals at zero degrees and 160 degrees of a machine cycle.

11. The apparatus of claim 2, further comprising:

means for detecting an error at said insertion station, and wherein said timing means is responsively connected to said error detection means for generating a signal to permit said finger to change its orientation.

12. The apparatus of claim 1, wherein said finger rotates about an axis from said finger first orientation to said finger second orientation.

13. The apparatus of claim 1, wherein said carriage linearly reciprocates in a direction toward said envelope opening station and in a direction away from said envelope opening station.

14. The apparatus of claim 1, further comprising:

a frame;

said envelope opening station being positioned proximate a front edge of said frame;

means for defining a path of travel for said carriage; and, means for connecting said path defining means to said frame in a manner whereby said path defining means is positionable in a first position while said carriage shoves an item into an opened envelope and is positionable in a second position for providing access to said envelope opening station, said second position being further from said envelope opening station than said first position.

15. The apparatus of claim 14, wherein said means for defining a path of travel defines a linear path along which said carriage reciprocates.

16. The apparatus of claim 14, wherein said connecting means comprises a pivotal connection proximate a rear edge of said frame.

17. The apparatus of claim 1, further comprising:

a frame;

said envelope opening station being positioned proximate a front edge of said frame;

said carriage being positionable in a first position wherein said carriage reciprocates in a direction toward said envelope opening station and in a direction away from said envelope opening station;

means connected to said frame for moving said carriage from said first position to a second position for providing access to said envelope opening station, said second position being further from said envelope opening station than said first position.

18. The apparatus of claim 17, wherein said moving means facilitates the pivoting of said carriage about an axis proximate a rear edge of said frame.

19. The apparatus of claim 1, wherein said carriage has five fingers mounted thereon.

20. The apparatus of claim 1, wherein said finger has an essentially rectangular planar portion with a first end whereat said finger connects to said carriage, a second end, and two sides, said second end having out-turned flanges thereon which side flanges commence proximate said first end and terminate a predetermined distance from said second end, said predetermined distance being chosen to size a gap suitable for accommodating at least one item as said finger ushers said item into said opened envelope.

21. A method of operating an insertion machine, said method comprising the steps of:

transporting at least one item to an insertion station;

transporting an envelope to an envelope opening station proximate said insertion station and at least partially opening said envelope at said envelope opening station;

reciprocating a carriage comprising said insertion station in a direction toward said envelope opening station and in a direction away from said envelope opening station; and, controlling the orientation of a finger which is movably mounted with respect to said carriage, said finger being movably mounted with respect to said carriage for movement to a finger first orientation whereat said finger is usable for inserting an item into an envelop and for movement to a finger second orientation whereat said finger is inoperative for inserting an item into an envelope;

detecting an error condition at said insertion station; and, moving said finger to said finger second orientation when an error condition is detected.

22. The method of claim 21, wherein said step of controlling the orientation of said finger comprises the steps of:

determining when it is permissible for said finger to change its orientation and generating a signal in accordance with said determination; and, determining whether said finger should be oriented in said finger first orientation or said finger second orientation when said signal is generated.

23. The method of claim 22, wherein said step of controlling the orientation of said finger further comprises the steps of:

using latch means for locking said finger in a selected orientation; and, unlocking said finger from said latch means in response to said signal.

24. The method of claim 22, wherein said step of determining whether said finger should be oriented in said finger first orientation or said finger second orientation comprises the steps of:

biasing said finger to its first orientation;

biasing said finger to its second orientation; and, determining which of said biasing means is to prevail in urging said finger to one of its orientations when said signal is generated.

25. The method of claim 22, wherein said step of determining when it is permissible for said finger to change its orientation involves the monitoring of a machine operating cycle and the generation of said signal at selected points in said machine operating cycle.

26. The method of claim 25, wherein said machine operating cycle is a 360 degree cycle, and wherein said signal is generated at zero degrees and 160 degrees of a machine cycle.

27. The method of claim 21, wherein said step of controlling the orientation of said finger involves the rotation of said finger about an axis from its finger first orientation to said finger second orientation.

28. The method of claim 21, wherein said reciprocation of said carriage is a linear reciprocation.

29. The method of claim 21, further comprising the steps of:

reciprocating said carriage comprising said insertion station in a direction toward said envelope opening station and in a direction away from said envelope opening station when said carriage is in a first position;

using means on said carriage to shove items at said insertion station into a flap-opened envelope when said carriage is in said first position and when said carriage is proximate said envelope opening station; and, moving said carriage from said first position to a second position for providing access to said envelope opening station, said second position for providing access to said envelope opening station, said second position being further from said envelope opening station than said first position.

30. The method of claim 29, wherein said step of moving said carriage involves the pivoting of said carriage about an axis.

31. An insertion machine comprising:

a frame;

an envelope opening station mounted on said frame;

means for positioning an envelope in said envelope opening station;

an insertion station positoined proximate said envelope opening station for inserting at least one item into an at least partially opened envelope, said insertion station including:

a carriage having means provided thereon for shoving an item into an opened envelope positioned at said envelope opening station when said carriage is proximate said envelope opening station;

means for defining a path of travel for said carriage whereby said carriage reciprocates in a direction toward said envelope opening station and in a direction away from said envelope opeining station; and, means for facilitating movement of said path defining means relative to said frame in a manner whereby said path defining means is positionable in a normal position while said carriage shoves an item into an opened envelope and is positionable in a clearance position for providing access to said envelope opening station, said means for facilitating movement of said path defining means comprising:

a shaft about which said path defining means is rotatable;

at least one arm member through which said shaft rotatably extends, said arm member being connected to said frame;

at least one guide rod engagable by said carriage, said guide rod being horizontally oriented when said path defining means is positionable in said normal position and having a first end thereof connected to said arm member; and, a ramp member connected to said arm member, said ramp member having a second end of said guide rod connected thereto, and wherein said ramp member has at least a portion thereof suspended above said guide rod.

32. An insertion machine comprising a frame;

an envelope opening station mounted on said frame;

means for positioning an envelope in said envelope opening station;

an insertion station positioned proximate said envelope opening station for inserting at least one item into an at least partially opened envelope, said insertion station including a carriage positionable in a first position wherein said carriage reciprocates in a direction toward said envelope opening station and in a direction away from said envelope opening station, said carriage having means provided thereon for shoving an item into an opened envelope positioned at said envelope opening station when said carriage is proximate said envelope opening station in said first position; and, means connected to said frame for pivoting said carriage from said first position to a second position for providing access to said envelope opening station when said carriage is in said second position, wherein said means for pivoting said carriage comprises:

a shaft about which said carriage is rotatable;

at least one arm member through which said shaft rotatably extends, said arm member being connected to said frame;

at least one guide rod engagable by said carriage, said guide rod being horizontally oriented when said carriage is positionable in said normal position and having a first end thereof connected to said arm member; and, a ramp member connected to said arm member, said ramp member having a second end of said guide rod connected thereto, and wherein said ramp member has at least a portion thereof suspended above said guide rod.

* * * * *